US005946884A

United States Patent [19]

Nordstrom et al.

[11] Patent Number: 5,946,884

[45] Date of Patent: Sep. 7, 1999

[54] WRAPPING MACHINE AND METHOD FOR USE WITH POLYETHYLENE WRAP

[75] Inventors: John E. Nordstrom, 4717 River Heights Dr., Manitowoc, Wis. 54220; Christopher J. Rusch, Two Rivers, Wis.

[73] Assignees: John E. Nordstrom; Barbara A. Nordstrom, both of Manitowoc, Wis.

[21] Appl. No.: 08/956,162

[22] Filed: Oct. 22, 1997

[51] Int. Cl.[6] ..... B65B 11/28

[52] U.S. Cl. ..... 53/225; 53/234; 53/375.9; 53/376.2; 53/387.3

[58] Field of Search ..... 53/225, 234, 375.9, 53/376.2, 377.8, 387.3

[56] References Cited

U.S. PATENT DOCUMENTS

| | | | |
|---|---|---|---|
| 2,110,815 | 3/1938 | Parsons . | |
| 2,301,016 | 11/1942 | Cannard . | |
| 2,363,751 | 11/1944 | Schultz et al. . | |
| 2,383,664 | 8/1945 | Malhiot . | |
| 2,642,707 | 6/1953 | Sandberg | 53/225 X |
| 2,822,652 | 2/1958 | Taggart et al. | 53/225 |
| 3,899,865 | 8/1975 | Revaz | 53/225 X |
| 4,183,191 | 1/1980 | Focke | 53/225 |
| 5,373,681 | 12/1994 | Shigeta | 53/225 |

FOREIGN PATENT DOCUMENTS

| | | | |
|---|---|---|---|
| 2229157 | 9/1990 | United Kingdom | 53/225 |

*Primary Examiner*—Linda Johnson
*Attorney, Agent, or Firm*—Ryan Kromholz & Manion, S.C.

[57] ABSTRACT

A machine and method for wrapping cylindrical workpieces such as rolls of bathroom tissue and paper towel. The machine includes a workpiece infeed conveyor, a wrapping film feeder, a rotating carousel having a plurality of pockets, an oscillating exit conveyor, a discharge conveyor, and a sealing conveyor. A piece of wrapping film supplied by the wrapping film feeder is perforated and burst into a single sheet. The film sheet and a workpiece are directed into a pocket in the rotating carousel whereby the sheet is banded around the periphery of the workpiece by a clamping plate, underfolder plate, and brush secured by heat sealing the film sheet to itself. The banded workpieces are ejected from the rotating carousel onto an exit conveyor which passes the workpieces to a discharge conveyor which in turn conveys the workpieces through a sealing conveyor. Folding mechanisms for folding the wrapping film sheet extending beyond the ends of the workpieces are disclosed. The method of wrapping is also disclosed.

13 Claims, 10 Drawing Sheets

WRAPPING MACHINE AND METHOD FOR USE WITH POLYETHYLENE WRAP

FIELD OF INVENTION

The present invention relates to the field of packaging machines for packaging workpieces. Specifically, the present invention relates to the packaging of wound paper products, like bathroom tissue and paper towels in thin films such as polyethylene films.

BACKGROUND OF THE INVENTION

In the past packaging or wrapping machines for cylindrical workpieces, such as rolls of bathroom tissue and paper towels, have suffered many drawbacks. For example, some packaging machines have not been able to package the bathroom tissues rolls or paper towel rolls as fast as these products are manufactured. This is especially true when only a small number of rolls are packaged together or when each roll is wrapped separately.

A marked improvement upon prior art packaging and wrapping machines for cylindrical workpieces was realized by an invention by Nordstrom and Rusch, disclosed in U.S. patent application ser. No. 08/671,971, now abandoned and hereby incorporated by reference. This wrapping machine utilizes a rotating carousel with a plurality of pockets arranged such that the wound paper roll is not rotated. The wrapping film and wound roll or workpiece are sequentially fed into each pocket as the carousel rotates and the wrapping process occurs as the carousel makes one complete revolution. A fully wrapped workpiece is ejected near the end of the revolution and another piece of wrapping film and workpiece are inserted. The workpieces are not rotated, relative to the carousel when wrapped; only the carousel is rotated.

The rotating carousel arrangement of the aforementioned Nordstrom and Rusch invention permits the wrapping of workpieces at rates that are equal to or higher than prior art wrapping machines and at a lower scrap rate. However, the prior Nordstrom invention is suited only for wrapping workpieces in paper wrappings. The various embodiments disclosed therein are not able to acceptably wrap workpieces in films made from polyethylene or other suitable materials. The present invention represents an improvement over the prior Nordstrom invention and the rest of the prior art packaging and wrapping machines in that the present invention, generally referred to herein as the film wrapping machine, is adapted and modified so as to be able to reliably and quickly wrap workpieces in thin film wrappers, such as printed polyethylene films.

The need for a film wrapping machine such as the one disclosed herein stems from the need or custom of wrapping bathroom tissues rolls or paper towel rolls in plastic films as opposed to paper wrappers. Many areas of the world, having more humid climates, require water proof plastic wrappers to keep bathroom tissue and paper towel rolls in usable condition. In other areas of the world not afflicted with high humidity, it has simply become the custom to wrap bathroom tissue and paper towel rolls in plastic film as opposed to paper wrappers. In either case, there is a need for a reliable and rapid wrapping machine that is capable of wrapping workpieces in thin films.

Recognizing this need, it is an object of our invention to provide a film wrapping machine that wraps cylindrical workpieces reliably at a high rate of speed with little or no scrap produced. It is an object of our invention to provide such a wrapping machine that utilizes clamping and underfolding devices to snugly wind and hold the wrapping film against the workpiece while it is wrapped. It is another object of our invention to apply the wrapper around the workpiece in a neat and secure fashion such that the wrapper fits snugly about the workpiece and there are no gaps between the wrapper and the workpiece. It is yet another object of our invention to provide a wrapping machine that is compact, can be easily moved, and is flexible with respect to the location of its infeed and exit conveyors.

These and other objects of our invention will become apparent in the descriptions that follow. We know of no prior art that teaches or discloses our invention.

SUMMARY OF THE INVENTION

Our invention comprises a wrapping machine for wrapping rolls of bathroom tissue, paper towels, and the like or equivalent. These products will be referred to herein as workpieces. Each workpiece has a cylindrical shape, an arcuate or curved outer surface, a pair of substantially circular substantially parallel outer sides or flat sides, and a center tube.

Our invention's primary components include a roll infeed conveyor, a wrapping film feeder, a frame structure, a main motor and transmission, a rotating carousel mechanism having a plurality of wrapping stations or pockets, a sealing drum with heated rollers, an oscillating exit conveyor, a discharge conveyor with folding plates, and a sealing conveyor. The wrapping film feeder includes a wrapping film roll unwinder, a dancer assembly having a festoon of rollers, a rotary cutter, a stationary cutter, and a pair of pinch rollers driven by another transmission. The rotating carousel rotates within the frame and is driven by the motor and transmission.

The wound rolls of paper product or workpieces to be wrapped are fed into our wrapping machine by a roll infeed conveyor. The wound rolls or workpieces enter our wrapping machine such that their center tubes are in an axial direction with respect to the rotating carousel of the wrapping machine. The infeed conveyor can be placed on either side of the wrapping machine carousel.

Roll infeed conveyors are well known in the art. Any infeed conveyor capable of delivering the workpiece to our wrapping machine in the proper orientation could be used. The preferred roll infeed conveyor is the one taught and disclosed in U.S. Pat. No. 4,360,098 entitled INFEED CONVEYOR issued on Nov. 23, 1982. The roll infeed conveyor taught and disclosed in U.S. Pat. No. 5,050,724 entitled ROLL INFEED CONVEYOR issued on Sep. 24, 1991 could be used as well. The specifications of the 4,360,098 and 5,050,724 patents are incorporated herein by reference.

The wrapping film utilized by our wrapping machine typically comes in a large roll. The wrapping film is loaded onto a unwind stand and is supported by a pair of driven unwind rollers capable of rotating the wrapping film roll. The unwind rollers apply a predetermined force to the wrapping film roll in order to accelerate, decelerate and uniformly feed wrapping film to our wrapping machine. The function of the unwind stand is to meet the wrapping film demand of the wrapping machine and eliminate the possibility of the wrapping film being torn as it is drawn into the wrapping machine.

The wrapping film is unwound from the wrapping film roll by the unwinder and is drawn into the wrapping machine at a ninety degree angle to the wrapping film roll by a pair of pinch rollers. In order to rotate the direction of the film by ninety degrees, the film is passed under and around a turning bar oriented at a forty five degree angle to the direction of travel of the film as it is unwound from the wrapping film roll. The pinch rollers are driven by a transmission which can be engaged and disengaged. Upon entering the machine, the wrapping film is threaded through the festoon of rollers of the dancer assembly. A set of upper rollers are mounted to the machine frame and a set of lower rollers are mounted on a pair of pivotable dancer arms. The purpose of the dancer arms is to prevent tearing of the wrapping film when the wrapping machine is first started. The dancer arms are also used as a control device for the unwind rollers.

In the idle mode, the carousel of our invention rotates at a predetermined rate. A sensing device, typically an electric eye, is attached to the infeed conveyor to determine the presence of workpieces to be wrapped. If a workpiece is not sensed, wrapping film is not fed into the machine. When the first workpiece to be wrapped is sensed by the device and enters the wrapping machine, there is an immediate acceleration of the wrapping film from rest to a wrapping film speed predetermined by the amount of wrapping film required to band and wrap one workpiece in one machine cycle. For reasons that will become evident, the predetermined wrapping film speed is always less than the predetermined speed of the carousel.

When the sensing device determines the presence of a workpiece, the pinch roller transmission engages and draws the wrapping film into the machine. If the wrapping film, which is relatively thin, was drawn by the pinch rollers directly from the large film roll, the wrapping film would likely tear during the initial acceleration. To prevent tearing, before engaging the pinch rollers, the wrapping film is threaded up and down over the plurality of rollers which form the dancer assembly.

Even with the aid of the unwind rollers, the roll of wrapping film cannot be sufficiently accelerated to meet the film demand rate of the machine. When the first workpiece enters the machine and the film roll is at rest, the greater rate of wrapping film acceleration required by the machine is compensated for by the web of film threaded through the festoon of rollers. As the film is accelerated into the machine, the pivoting bars to which the lower rollers are attached move upward toward the upper rollers to compensate for the accelerating film demand. Through electromechanical means, the pivoting bars are connected to the unwind stand. As the pivoting bars raise, the unwind rollers engage and unwind the wrapping film from the roll. As the unwinder accelerates and continues to unwind, the pivoting bars now fall from their raised position to an equilibrium position where the wrapping film is fed into the machine at a rate less than the rate at which the machine is operating.

Because the rolls of wrapping film are heavy a ramp is provided to permit the rolls of wrapping film to be rolled onto the driven unwind rollers.

As previously stated, the wrapping film is drawn into our wrapping machine between a pair of pinch rollers which can be engaged and disengaged by a transmission. Next, a rotary blade scores or perforates the wrapping film at a predetermined position. The rotary blade works in conjunction with a knife. The knife has one or more nicks so that the rotary blade does not cut the entire width of the wrapping film. The knife can be moved up into an engaged cutting position or down into a non-cutting position.

The rotary blade cuts the wrapping film to a predetermined length. The length is determined by adding the workpiece circumference and the required wrapping film lap. The lap is typically one inch.

The film is then fed downward by the pinch rollers toward the rotating carousel mechanism at a speed rate slower than that of the rotating carousel. Below the carousel are located twin timing belts which each contain small raised portions or tabs. The speed of the timing belts matches the speed of the outside diameter of the carousel. On the outside diameter of the carousel are located vacuum blocks, one adjacent to each pocket. As the carousel vacuum block and one of the tabs on each belt come together, the wrapping film is captured between the vacuum block and the respective tab of each belt. The speed differential between the pinch rollers and the faster speed of the timing belts and the vacuum blocks on the outside diameter of the carousel causes the wrapping film to burst or tear at the perforation.

This action transfers individual sheets of wrapping film onto the carousel in the correct location for each pocket opening. Each vacuum block is located above each carousel pocket. After the perforation is torn and the separated sheet is transferred to the carousel, a vacuum is applied to the vacuum block, and the tabs on the timing belts drop away. The wrapping film is now attached to the carousel at the vacuum block by vacuum only. The leading portion of the wrapping film sheet is held by the vacuum, the middle portion of the wrapping film sheet is positioned so that it covers the pocket opening, and the trailing portion of the wrapping film sheet extends beyond the pocket opening.

As the workpieces to be wrapped enters the wrapping machine from the infeed conveyor, they are pushed by the conveyor onto a curved ramp having twin ramp surfaces. The ramp extends upward and toward a portion of the carousel, the curvature or arc of the ramp being eccentric to the perimeter of the carousel. As the ramp surface extends upward, its bottom surface get closer to the outer diameter of the carousel.

At this point one flight, of a plurality of flights attached to a chain conveyor, contacts the workpiece tangentially at the ramp base and guides it up the ramp into a wrapping station or pocket in the carousel. The flights and pockets are timed such that as each flight rises from the bottom of the machine between the twin ramp surfaces, it remains aligned with a pocket on the carousel. As the carousel rotates at its rate of rotation, the flight pushes the workpiece up the ramp at the same rate of speed and into the pocket.

Because the middle portion of the wrapping film sheet covers the pocket opening, as the ramp and flight guide the workpiece into the pocket, the wrapping film covers a portion of the workpiece as it also enters the pocket. Once in the pocket, approximately 240 degrees of the arcuate surface of the workpiece is covered by the wrapping film sheet. Only the wrapping film sheet leading portion and trailing portion extend out of the pocket opening.

As the workpiece is pushed up the ramp by one of the flights, an extended ejector bar comes into contact with the workpiece having the wrapping film trapped in between. As the workpiece is slowly pushed into the pocket by the flight and ramp, the ejector bar retracts into the pocket but constantly holds a slight pressure on the workpiece and wrapping film. The ejector bar path substantially matches the ramp path. Furthermore, the ejector bar ejection length can be adjusted for any workpiece diameter. Without the ejector bar maintaining a slight pressure on the workpiece and wrapping film, it is possible for the workpiece to rotate or turn as it is pushed into the pocket by the flight and ramp. There is also a possibility that the wrapping film will move unrestricted within the pocket. The pressure maintained by the ejector rod on the wrapping film and the workpiece prevents the workpiece from rotating and the wrapping film from wandering within the pocket. The result, which is explained in detail below, insures that the ends of the wrapping film are the same length and accordingly a proper lap is consistently formed at the same location.

To ensure that the workpiece fully enters the carousel pocket, an optional pushing mechanism is employed to push the workpiece completely into the pocket if necessary. The poking pushing mechanism is driven by the same power source that powers the chain conveyor to which the flights are attached. The mechanism comprises an eccentric, a first bar member, a pivoting member, a second bar member, a roller, and a third bar member. The center of the eccentric is attached to the power source. The first bar member is connected to the edge of the eccentric at one end and to the pivoting member at the other end. The second bar member is connected to the pivoting member at one end and to the axis of the roller on the opposite end. The third bar member is also attached to the axis of the roller on one end and the wrapping machine frame on the other end. The pivoting member has a third connecting point whereby the pivoting member is pivotally connected to the wrapping machine frame.

The pushing mechanism is timed with the carousel such that after each workpiece has been ramped into a pocket, the roller attached to the end of the second bar member enters the pocket a predetermined distance and makes contact with the workpiece thereby pushing the workpiece completely into the pocket. The second bar member also includes a compression mechanism so that the workpiece is not damaged or crushed within the pocket. The compression mechanism has a predetermined compression force rate so that when the workpiece is fully positioned within the pocket, the second bar member compresses or shortens in length thus preventing damage to the workpiece.

The pushing mechanism roller withdraws completely from the carousel pocket to a location outside of the diameter of the carousel before the pocket opening sufficiently rotates to a position where the inserted roller would strike the carousel. As each carousel pocket passes the location of the pushing mechanism, the roller contacts the workpiece, pushes the workpiece completely into the pocket if necessary, and retracts before the carousel pocket moves past the pushing mechanism location.

In order to institute the folding of the excess wrapping film into planar contact with the workpiece sides, a pair of stationary side folders are fixedly mounted to the carousel adjacent to each of the pockets of the carousel. As the workpieces are ramped into contact with the wrapping film sheet and into the pocket or wrapping station, the stationary side folders contact the portion of the excess wrapping film that extends beyond each end of the workpiece and folds these portions into planar contact with the ends of the workpiece. In addition to performing this first folding operation, the stationary side folders support the overlapped edges of the wrapping film that is wrapped about the workpiece once the workpiece has been received in the pocket. This support function is imperative as the sealing rollers will seal the lapped portion of the wrapping film along its entire width only if the wrapping film is resiliently supported against the pressure that the sealing rollers will exert upon the workpiece. To provide resiliency to the otherwise rigid support surface provided by the stationary side folders, a sealing roller pad is affixed to a shoulder piece of the stationary side folders immediately beneath the location that will be contacted by the sealing rollers. Each stationary side folder is comprised of a tongue positioned in planar parallel relation to the end of the workpiece that is received in the pocket or wrapping station of the carousel, the tongue depending from a substantially cylindrical shoulder piece, the shoulder piece having affixed to its outermost surface a heat resistant resilient sealing pad, and a folder support bar fixedly connected to the frame structure and to the shoulder piece so as to rigidly support the tongue in its preferred position.

As the carousel continues to rotate and after the workpiece has fully entered the pocket, a clamping mechanism, including a clamping plate and driven by an underfolder plate linkage, clamps the workpiece and wrapping film sheet firmly into the pocket. After further carousel rotation an underfolder mechanism, including an underfolder plate connected to an underfolder arm, passes upward and across the opening in the pocket where the wrapping film and workpiece are now clamped. As the underfolder plate moves up and across the opening, the trailing wrapping film portion is directed upward and completely over the workpiece. The underfolder plate and clamp hold the trailing wrapping film portion snugly against the workpiece so that there are no air pockets or gaps between the wrapping film and the workpiece.

The remaining exposed wrapping film end next encounters a brush mounted to the wrapping machine frame such that its bristles contact the outer diameter surface of the rotating carousel. When the carousel pocket arrives at the location of the brush, the remaining exposed wrapping film end or leading portion is brushed over the trailing portion of the wrapping film by the brush bristles to form the lap. The wrapping film sheet is now fully banded in a cylindrical fashion or tube around the outer circumference of the workpiece. The side edges of the wrapping film sheet now extend outward a predetermined distance beyond the flat circular parallel sides of the workpiece.

A wide flat sealing belt is supported by the frame over the top portion of our wrapping machine. The belt is supported by a plurality of pulleys, one of which is powered by a transmission that is coupled to the main motor of the wrapping machine. When the pocket containing the workpiece first comes into contact with the belt, the underfolder plate partially retracts and the belt comes into contact with the exposed portion of the wrapping film including the lap. The belt holds the wrapping film firmly against the workpiece during the subsequent sealing operation of the wrapping film sheet. The sealing belt further covers at least one workpiece of the carousel.

A sealing drum for sealing the lapped edges of the wrapping film wrapped about the workpieces is rotationally mounted within the sealing belt on a shaft affixed to the frame of our wrapping machine. The sealing drum is further comprised of a pair of side plates fixedly mounted in identical orientation upon the shaft, a plurality of sealing rollers adjustably mounted between the side plates, and a pair of electrically activated air cylinders coupled to the slide bars so as to adjust the radial position of the sealing rollers. Each of the sealing rollers is mounted upon a pair of slide bars retained between the side plates by a plurality of rollers that permit the sealing rollers to be moved in a linear fashion in a radial relation to the center of the shaft. Furthermore, the drum is synchronized to rotate so that one of the heated sealing rollers mounted upon the drum can come into sealing contact with the lap of the wrapping film wrapped about the workpiece received by the pocket of the carousel. The heated sealing rollers do not directly contact the wrapping film wrapped about the workpiece but instead contact the sealing belt that is retaining the wrapping film in its desired position on the workpiece. The sealing belt is preferably fashioned of some heat resistant and non-stick material so that the belt will not melt when contacted by the sealing roller and so that the wrapping film being sealed will not stick to the belt. The heat of the sealing roller is conducted through the sealing belt and melts the lapped portion of the wrapping film on the workpiece so as to seal the lapped portion of the wrapping film together. The pressure exerted upon the workpiece by the sealing roller is controlled by a pair of air cylinders mounted within the sealing drum that adjust the radius of rotation of the sealing rollers. The sealing rollers are mounted at one hundred eighty degrees to one another and are coupled to the air cylinders such that the sealing rollers will be caused to move radially inwardly or outwardly. By regulating the radius of the sealing drum, the rigid sealing rollers can be pressed into the resilient workpieces to a greater or lesser extent, the pressure being exerted upon the workpieces being directly related to the depth to which the sealing roller are pressed into the workpieces. As is evident, the resilient sealing pad supporting the lapped edges of the wrapping film extending beyond the edges of the workpiece is necessary to prevent damage to the sealing rollers or to the stationary side folders that would result should there be a direct contact between these generally rigid members.

The rotating carousel pocket next rotates to an oscillating exit conveyor where a pair of upper and lower conveyor belts, having a fixed gap of adjustable dimension and moving linearly at the same rate as the rate of rotation of the carousel, grips each wrapped workpiece as it is ejected by an ejector bar within the pocket. The ejector bar remains in its fully extended position until a new workpiece begins to be ramped into the pocket. As described above, the ejector bar retracts as the workpiece is ramped into the pocket by the flight and ramp and constantly maintains a slight pressure on the workpiece and the wrapping film.

Mounted on each side of the exit conveyor is a side folding plate that, like the stationary side folders mounted adjacent the pockets, contacts and folds a second quadrant of the wrapping film that extends beyond the ends of the workpiece into planar contact with the ends of the workpieces as the conveyor belts carry the wrapped workpiece to a discharge conveyor. Once on the discharge conveyor, the remaining two quadrants of the wrapping film extending beyond the ends of the workpieces are folded into planar contact with the ends of the workpieces by a pair of up-folder plates mounted on either side of the discharge conveyor immediately adjacent the exit conveyor and by a pair of down-folder plates mounted on either side of the discharge conveyor immediately adjacent the up-folder plates. The wrapped workpieces, having neatly folded ends are transported to a sealing conveyor comprised of a pair of opposing vertically oriented sealing belts. The sealing belts contact the ends of the wrapped workpieces with sufficient force to support the workpieces between the belts. The first portion of the belts that the workpieces encounter are backed by heating elements that, like the sealing rollers of the sealing drum, transfer heat through the sealing belts to the folded ends of the wrapping film on the ends of the workpieces. The heat is sufficient to seal the folded ends of the workpieces and secure the folds into planar contact with the ends of the workpiece. The second portion of the belts that the workpieces encounter before being ejected from the sealing conveyor are backed by a plurality of cooling elements that, through simple heat transfer or through refrigeration augmented heat transfer, cool the ends of the workpieces so that the ends are not tacky when they emerge from the sealing conveyor. The wrapped workpieces are transported to a location where they are collated, boxed, cartoned, cased, etc.

It should be understood that each embodiment of the present invention disclosed herein may be described in a preferred embodiment depending upon the commercial concerns regarding the product produced by each embodiment. Therefore, depending upon the desired commercial application each embodiment disclosed herein may separately be considered a best mode of the invention depending upon the goals of the person using the apparatus and/or method disclosed herein.

DETAILED DESCRIPTION

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
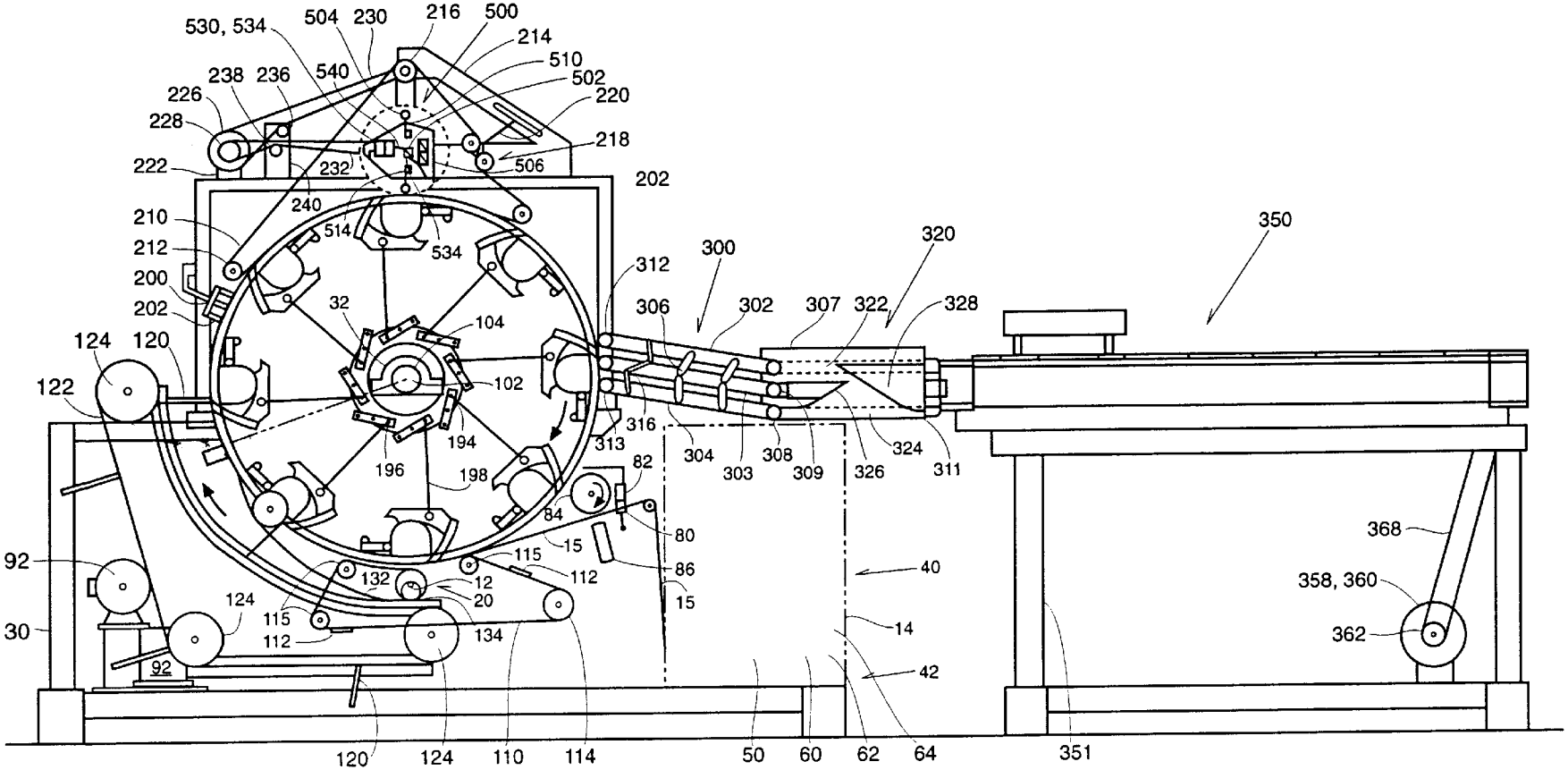
FIG. 1 is a front elevational view of our wrapping machine.
Figure 2:
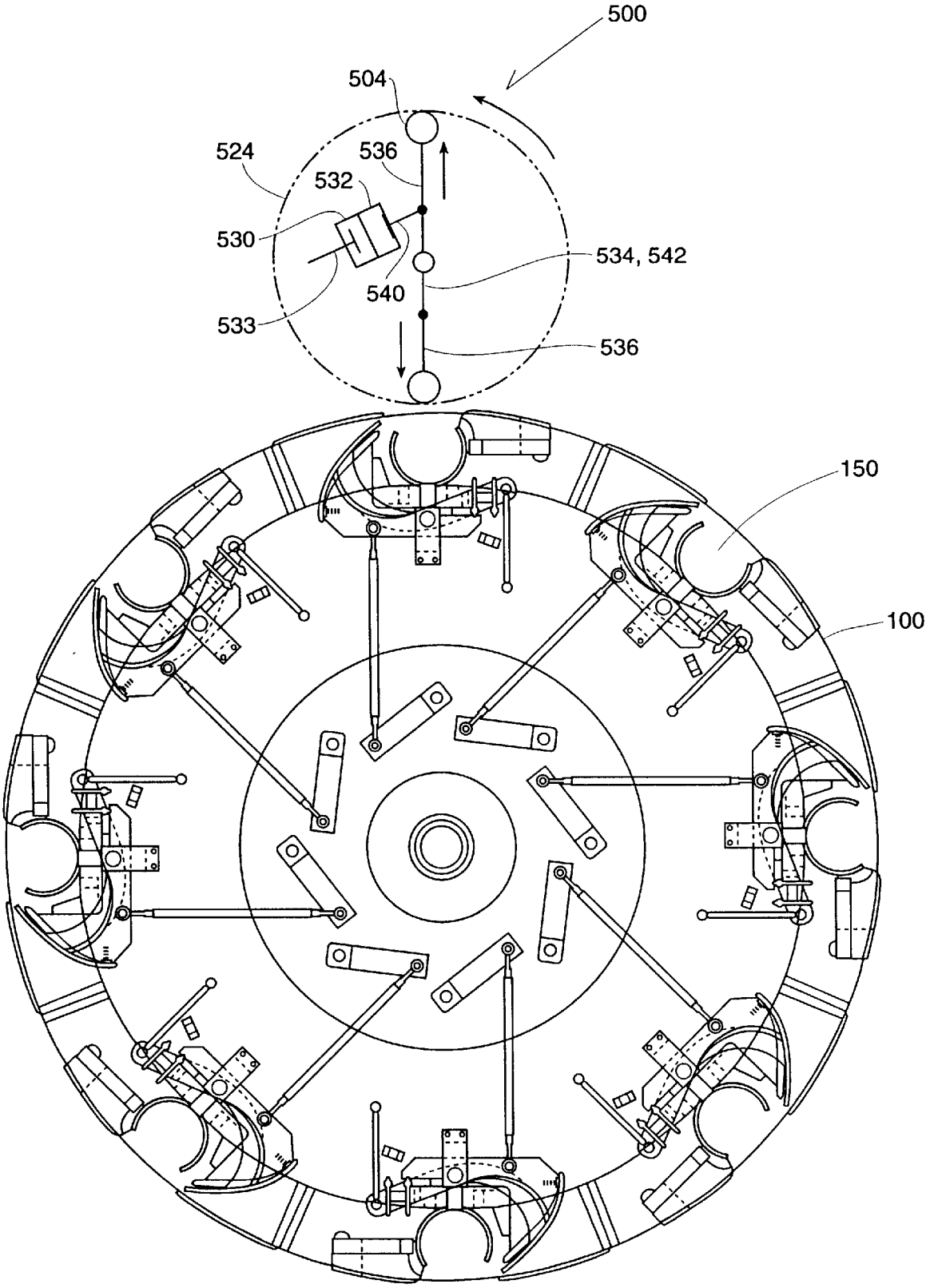
FIG. 2 is a detailed front elevational view of the front side of the carousel and the sealing drum showing the relative rotation of the carousel and the sealing drum.

Our invention, shown generally in FIG. 1 comprises a workpiece wrapping machine 10 for applying a film wrapper 18 to a roll of bathroom tissue, paper towel, or workpiece 12. Its primary components include an infeed conveyor 20, a frame structure 30, a wrapping film unwinder 40, a main motor 90 and transmission 92, a rotating carousel mechanism 100 having a plurality of wrapping stations or pockets 150, a wrapped product exit conveyor 300, a discharge conveyor 320 with folding plates 326 and 328, and a sealing conveyor 350.

An electric three (3) horsepower motor 90 is mounted within frame structure 30. The motor 90 is coupled to a worm and gear reducer or transmission 92. From transmission 92, power is distributed to various components of our film wrapping machine 10 as further described.

The carousel mechanism 100 is rotatably supported within frame 30 by axle 102 and bearing blocks 32. The carousel 100 rotates on its axle 102 and is driven by rotary power derived from transmission 92. In our preferred embodiment, the carousel 100 has eight (8) pockets 150. However, it is to be understood that the number of pockets 150 in carousel 100 could be changed without varying from our invention.

The wound rolls of paper product or workpieces 12 to be wrapped are fed into our film wrapping machine 10 by a roll infeed conveyor 20. Referring to FIG. 1, the placement of the infeed conveyor 20 can be seen; however, it could be located on either side of the wrapping machine 10. Infeed conveyors 20 are well known in the art. The roll infeed conveyor used in our preferred embodiment is the one taught and disclosed in U.S. Pat. No. 4,360,098 entitled INFEED CONVEYOR issued on Nov. 23, 1982. The workpieces 12 enter our film wrapping machine 10 such that their center tubes 13 are oriented in an axial direction with respect to the rotating carousel 100 of the wrapping machine 10. The infeed conveyor 20 has a plurality of flight bars or pusher rods. The pusher rods are identified at reference numerals 78, 79, and 80 in the 4,360,098 patent. Each flight bar or pusher rod pushes a workpiece 12 into our film wrapping machine 10. When the workpiece 12 has been conveyed to the proper location, the flight bar or pusher rod drops below the surface upon which the workpiece 12 is conveyed.

As shown in FIG. 1, the wrapping film feeder 40 includes a wrapping film roll unwind stand 42, a turning bar 50, a dancer 60 having a festoon of upper rollers 62 and lower rollers 64, a pair of pinch rollers 80 driven by a second transmission 82, a rotary cutter 84, and a movable blade 86.

The wrapping film 15 utilized by our film wrapping machine 10 typically comes in a large roll 14. The wrapping film 15 is typically a polyethylene film, although other types of film could be used. The roll 14 is loaded onto the unwind stand 42 by rolling the roll 14 onto a pair of driven unwind rollers 46 (not shown) with the aid of a ramp 43 (not shown). No lifting of the roll 14 is required. The roll 14 is free to rotate upon driven unwind rollers 46. The driven unwind rollers 46 are driven by a motor 54 (not shown) which is actuated by a potentiometer switching mechanism 68 discussed below. The rollers 46 apply a predetermined force to the wrapping film roll 14 in order to accelerate, decelerate, and uniformly feed wrapping film 15 to our wrapping machine 10.

The wrapping film 15 is unwound from the film roll 14 by the driven unwind rollers 46 and is drawn into the wrapping machine by a pair of pinch rollers 80. As the wrapping film 15 is unwrapped from the film roll 14 at a ninety degree angle to the orientation at which it enters the wrapping machine 10, it is necessary to first pass the wrapping film 15 under and around a turning bar 81 (not shown) oriented at a forty five degree angle to the direction of travel of the wrapping film 15 as it is unwound from the wrapping film roll 14 and as it enters the wrapping machine 10. Upon entering the machine 10, the wrapping film 15 is first threaded beneath a first single roller 56 to a second single roller 58 and then through a festoon of upper rollers 62 and lower rollers 64. The set of upper rollers 62 are mounted to the frame 30 and the set of lower rollers 64 are mounted between a pair of pivotable arms 66. The rollers 62 and 64 form dancer 60. The wrapping film 15 wound through the dancer 60 forms a web 16. The purpose of the dancer 60 and web 16 is to prevent tearing the wrapping film 15 when the wrapping film 15 is first fed into the wrapping machine 10.

The rotating shaft of a potentiometer 68 is connected to one of the pivoting arms 66. The potentiometer 68 controls the speed of unwinder motor 54. When wrapping film 15 is initially drawn in the machine 10, web 16 is shortened and pivoting arms 66 rise. As pivoting arms 66 rise and rotate the shaft on potentiometer 68, potentiometer 68 actuates unwinder motor 54 so that wrapping film 15 is unwound from roll 14 by the driven unwind rollers 46. The upper and lower rollers 62 and 64 and pivoting arms 66 of dancer 60 as well as potentiometer 68 and unwinder motor 54 are not shown in detail in the figures. These components are well known in the art.

The pair of pinch rollers 80 draws the wrapping film 15 into the machine 10. The pinch rollers 80 are controlled by a transmission 82 which can be engaged and disengaged. Adjacent to the pinch rollers 80 is located a rotary knife 84. A movable blade 86 is positioned below the rotary knife. When actuated, the movable blade 86 rises approximately 0.030 inch (0.0762 centimeter) to perforate or score the wrapping film 15 into wrapping film sheets 18. The film width is perforated and not completely cut by rotary knife 84 and movable blade 86. Blade 86 includes three notches and the film 15 is not cut at each notch.

The rotary knife 84 and movable blade 86 perforate the wrapping film 15 to a predetermined length. The length is determined by adding the workpiece 12 circumference and the required wrapping film lap 18*a*. The workpiece diameter varies from 3.5 inches (8.9 centimeters) to 5.5 inches (14.0 centimeters). The lap 18*a* is typically one inch (2.54 centimeters). The workpiece 12 length or cut length also varies from 3.5 inches (8.9 centimeters) to 4.5 inches (11.4 centimeters).

In the idle mode, the carousel 100 of our invention 10 rotates at a rate of approximately 12.5 revolutions per minute. An electric eye 28 is attached near the end of the infeed conveyor 20 to determine the presence of workpieces 12 to be wrapped. If a workpiece 12 is not sensed, wrapping film 15 is not fed into the machine 10. When the first workpiece 12 to be wrapped is sensed by the eye 28 and enters the wrapping machine 10, there is an immediate acceleration of the wrapping film 15 by the pinch rollers 80 from rest to a speed predetermined by the amount of wrapping film required to band and wrap one workpiece 12 in one machine cycle. The predetermined speed is calculated using the diameter of the workpiece to be wrapped and the desired lap 18*a*. In all cases, the predetermined speed will be less than the carousel rate of rotation.

When the eye 28 determines the presence of a workpiece 12, the pinch roller transmission 82 engages and draws the wrapping film 15 into the machine 10. If the wrapping film 15, which is relatively thin, was drawn by the pinch rollers 80 directly from the large film roll 14, the wrapping film 15 would likely tear or stretch during the initial acceleration. To prevent tearing or stretching, before engaging the pinch rollers 80 the wrapping film 15 is threaded up and down in a web 16 over the plurality of rollers 62 and 64 which form the dancer 60.

Even with the aid of the driven unwind rollers 46, the roll of wrapping film 14 cannot be sufficiently accelerated to meet the film demand rate of the machine 10. When the first workpiece 12 enters the machine 10 and the film roll 14 is at rest, the rate of wrapping film acceleration imparted by the pinch rollers 80 is compensated for by the web 16 of film 15 threaded through the dancer 60. As the film 15 is accelerated into the machine 10, the pivoting arms 66 to which the lower rollers 64 are attached pivot upward toward the upper rollers 62 to compensate for the accelerating film demand. As the pivoting arms 66 rise, the potentiometer 68 actuates the driven unwind rollers 46 which unwind wrapping film 15 from the roll 14. As the driven unwind rollers 46 accelerate and continue to unwind the film 15, the pivoting arms 66 begin to fall from their raised position to an equilibrium position where the wrapping film 15 is fed to the machine 10 at the same rate the machine 10 is operating.

The film 15 is then fed downward by the pinch rollers 80 toward the rotating carousel 100 at a rate of speed slower than that of the rotating carousel. Below the carousel 100 are located twin timing belts 110 which each contain small raised portions or tabs 112. As shown in FIG. 1, the timing belts 110 ride on timing belt sheaves 114 and 115. The speed of the timing belts 110 matches the speed of the outside diameter of the carousel 100. On the outside diameter of the carousel 100 are located vacuum blocks 140, one adjacent and above each pocket 150 in carousel 100. As the carousel vacuum block 140 and one of the tabs 112 on each belt 110 come together, the wrapping film 15 is captured between the vacuum block 140 and the respective tab 112 of each belt 110. The speed differential between the pinch rollers 80 and the carousel 100 causes the wrapping film 15 to burst or tear at the perforation into individual sheets 18.

This action transfers individual sheets of wrapping film 18 onto the carousel 100 in the correct location for each pocket opening 152. After the perforation is torn and the separated sheet 18 is transferred, a vacuum is applied to the vacuum block 140 and the tabs 112 on the timing belts 110 drop away. A vacuum motor 142 is mounted to frame 30. The vacuum motor 142 is connected by a conduit 143 to a vacuum manifold 144 located around the axle 102 of rotating carousel 100. From the manifold 144, smaller conduits 145 run to each vacuum block 140. The manifold 144 includes a vacuum valve 146 mounted to frame 30 through suitable brackets and a vacuum drum 148 mounted to axle 102 for applying a vacuum to each vacuum block during the required portion of the carousel cycle.

The vacuum blocks 140 are also provided with one or more ports 147 for releasing a jet of high pressure air. High pressure air is typically supplied by an air system 142*a* present in the building housing the film wrapping machine 10. The air system 142*a* is connected by a conduit 143*a* to a pressure manifold 144*a* located around the axle 102 of rotating carousel 100. From the manifold 144*a*, smaller conduits 145*a* run to each vacuum block 140. The manifold 144*a* includes a pressure valve 146*a* mounted to frame 30 through suitable brackets and a pressure drum 148*a* mounted to axle 102 for releasing high pressure air to each vacuum block 140 during the required portion of the carousel cycle. The application of the high pressure air jet is described in detail below.

The wrapping film sheet 18 is now attached to the carousel 100 at the vacuum block 140 by vacuum only. The leading portion of the wrapping film sheet 18 is held by the vacuum, the middle portion of the wrapping film sheet 18 covers the pocket opening 152, and the trailing portion of the wrapping film sheet 18 extends beyond the pocket opening 152.

As each workpiece 12 to be wrapped enters the film wrapping machine 10 from the infeed conveyor 20, it is pushed by the conveyor 20 onto a curved ramp 130 that extends upward and around a portion of the carousel 100. The ramp 130 is best shown in FIG. 1. As the ramp 130 extends upward, its bottom surface 132 gets closer to the outer diameter of the carousel 100.

Also referring to FIG. 1, it can be seen that a plurality of flights 120 are attached to a chain conveyor 122. The chain conveyor 122 is driven on a series of sprockets, one of which derives its power from transmission 92. The center of the arc made by the chain conveyor 122 is the same as the center of the carousel 100 diameter. Thus, the flights 120 remain a fixed distance from carousel 100 as they travel around the arc. A flight 120 contacts the workpiece 12 tangentially at the ramp base 134 and guides the workpiece 12 up the ramp along its bottom surface 132 into a pocket 150 in the carousel 100. The flights 120 and pockets 150 are timed such that as each flight 120 rises from the bottom of the machine 10, it is aligned with a pocket 150 on the carousel 100. As the carousel 100 rotates at its rate of rotation, each flight 120 pushes a workpiece 12 up the ramp 130 at the same rate of speed and into a pocket 150. While the flights 120 remain at the fixed distance from the carousel 100, the ramp surface 132 gets closer to the carousel 100 as the ramp 130 extends about the carousel 100.

Because the middle portion of the wrapping film sheet 18 covers the pocket opening 152, as the ramp 130 and flight 120 guide the workpiece 12 into the pocket 150 the wrapping film sheet 18 also enters the pocket 150 and surrounds a portion of the workpiece 12. Once in the pocket 150, approximately 240 degrees of the workpiece 12 is covered by the wrapping film sheet 18. Only the wrapping film sheet 18 leading portion 19*a* and trailing portion 19b extend out of the pocket opening 152.

Figure 3:
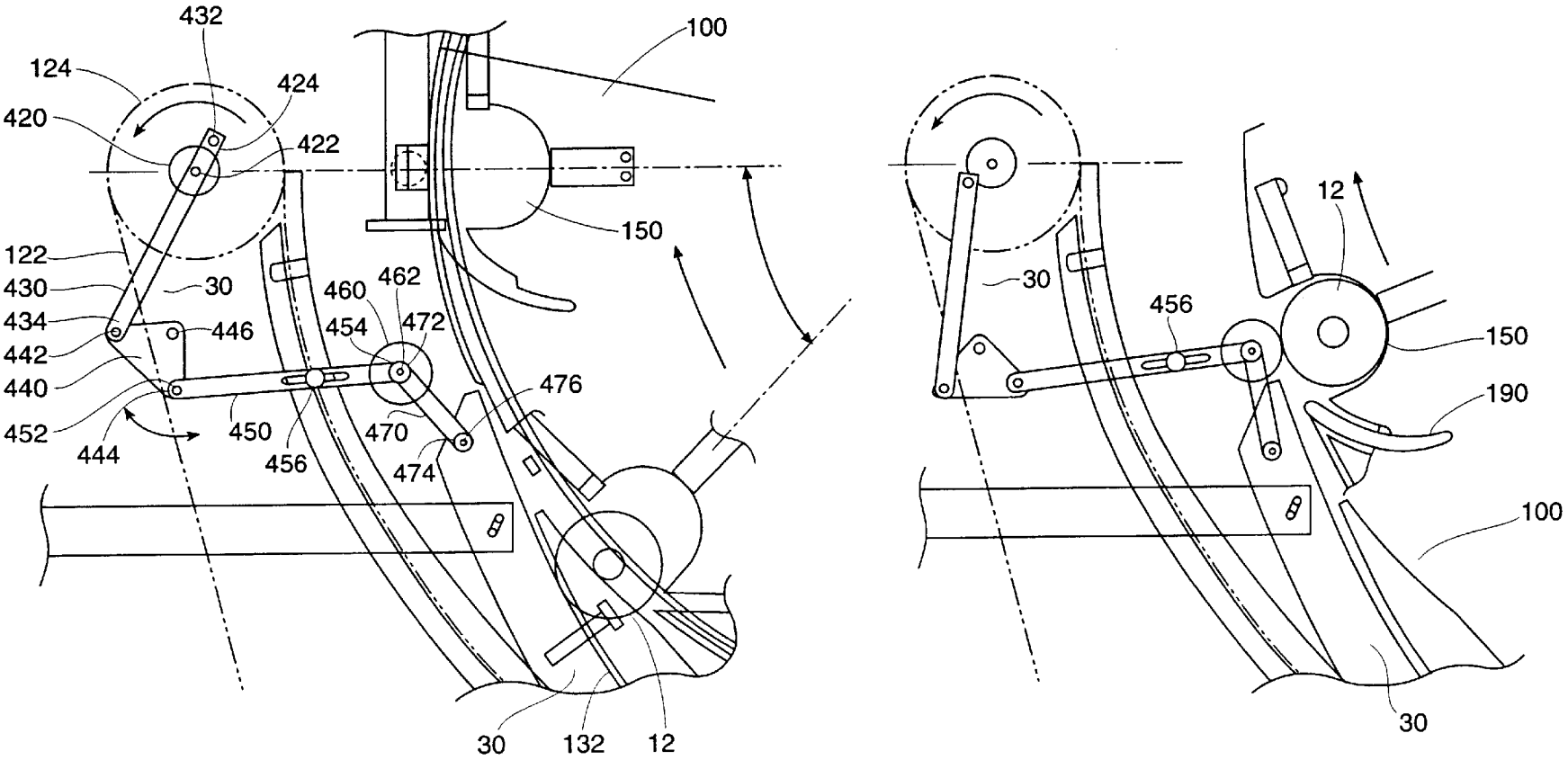
FIG. 3 is two detailed front elevational views of the carousel and the poker mechanism showing the poker mechanism in its retracted position and in its engaged position.

To insure that each workpiece 12 fully enters each carousel pocket 150 , an optional pushing mechanism 410 is employed to push each workpiece 12 completely into the pocket 150 if necessary. The pushing mechanism is shown in FIG. 3. The pushing mechanism 410 is driven by motor 90 and transmission 92 which also powers the chain conveyor 122 to which flights 120 are attached. The mechanism 410 comprises the following components: an eccentric 420, a first bar member 430, a pivoting member 440, a second bar member 450, a roller 460, and a third bar member 470. The center 422 of the eccentric 420 is attached to the same axle that sheave 124 rotates on. End 432 of first bar member 430 is connected to the edge of the eccentric 420 at point 424. End 434 of first bar member 430 is attached to the pivoting member 440 at point 442. An end 452 of second bar member 450 is connected to the pivoting member 440 at point 444 while end 454 is connected to the axis 462 of the roller 460. The third bar member 470 is also attached to the axis 462 of the roller 460 on an end 472. The opposite end 474 is connected to the wrapping machine frame 30. Pivoting member 440 has a third connecting point 446 also pivotally connecting it to the wrapping machine frame 30.

The pushing mechanism 410 is timed with the carousel 100 such that after each workpiece 12 has been ramped into a pocket 150, roller 460 enters the pocket 150 a predetermined distance and makes contact with the workpiece 12 thereby pushing the workpiece 12 completely into the pocket 150. To prevent damage to the workpiece 12, second bar member 450 also includes a compression mechanism 456. In the preferred embodiment, the second bar member 450 is broken into two pieces that are connected by spring. The spring has a predetermined compression spring rate so that when the workpiece 12 is fully positioned within the pocket 150, the second bar member 450 compresses or shortens in length thus preventing damage to the workpiece 12.

Roller 460 withdraws completely from the carousel pocket 150 to a location outside of the diameter of the carousel 100 before the pocket opening 152 sufficiently rotates to a position where the inserted roller 460 would strike the carousel 100. As each carousel pocket 150 passes the location of the pushing mechanism 410, roller 460 contacts the workpiece 12, pushes the workpiece 12 completely into the pocket 150 if necessary, and retracts before the carousel pocket opening 152 moves past the pushing mechanism location.

Figure 5:
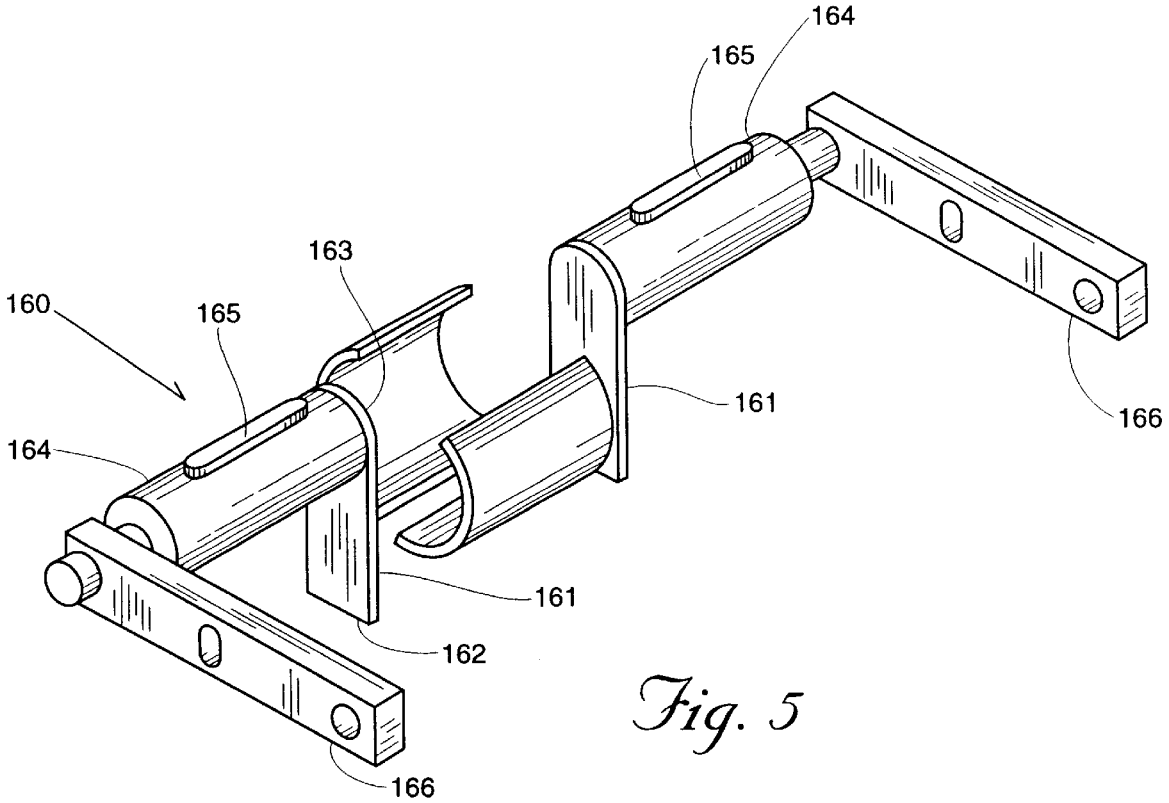
FIG. 5 is a detailed orthographic view of a pair of stationary side folders in relation to a pocket.
Figure 12:
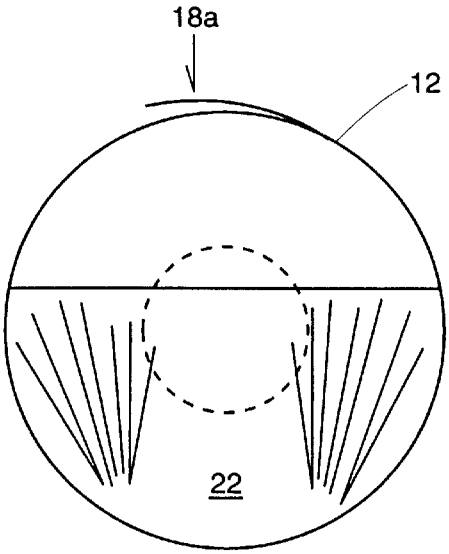
FIGS. 12–15 are schematic views of the end of a workpiece showing the manner in which the excess wrapping film is folded into planar contact with the ends of the workpiece.

A pair of stationary side folders 160, as shown in FIG. 5, bracket the ends of each pocket 150. Each of the side folders is spaced (approximately 0.125 inches) from the longitudinal ends of each pocket 150. As the workpiece 12 is ramped into contact with the wrapping film sheet 18 and into the pocket 150, the stationary side folders 160 contact the excess wrapping film 18 that extends beyond the ends of the workpiece 12 and fold a first quadrant 22 (FIG. 12) of the excess wrapping film 18 toward the center or core 13 of the workpiece 12. The stationary side folders 160 are fixed in place and maintain the fold after full workpiece 12 insertion into the pocket 150.

Each stationary side folder 160 is comprised of a tongue 161, a shoulder piece 164, and a folder support bar 166. The tongue 161 of each of the pair of side folders 160 is symmetrically arranged with the other and with the pocket 150, each tongue 161 is also oriented radially with respect to the carousel 100. Each of the tongues 161 of a pair of stationary side folders 160 occupies a plane that is parallel to the planes defined by the longitudinal ends of the pocket 150. A lower end 162 of each tongue 161 extends radially below each pocket 150 and an upper end 163 of the tongue 161 is affixed to a cylindrical shoulder piece 164, the upper end 163 of the tongue 161 having substantially the same radius as the shoulder piece 164. The shoulder piece 164 extends normal to the tongue 161, away from the pocket 150 and is affixed to a folder support bar 166 which is in turn connected to the carousel 100 and which rigidly supports the tongues 161 and shoulder pieces 164 in their positions adjacent the ends of the pocket 150. Each shoulder piece 164 of the stationary side folder 160 has mounted thereon a sealing roller pad 165. The sealing roller pad 165 is mounted on the shoulder piece 164 such that the outer surface of the pad 165 intersects the circumference of the carousel 100.

Figure 4:
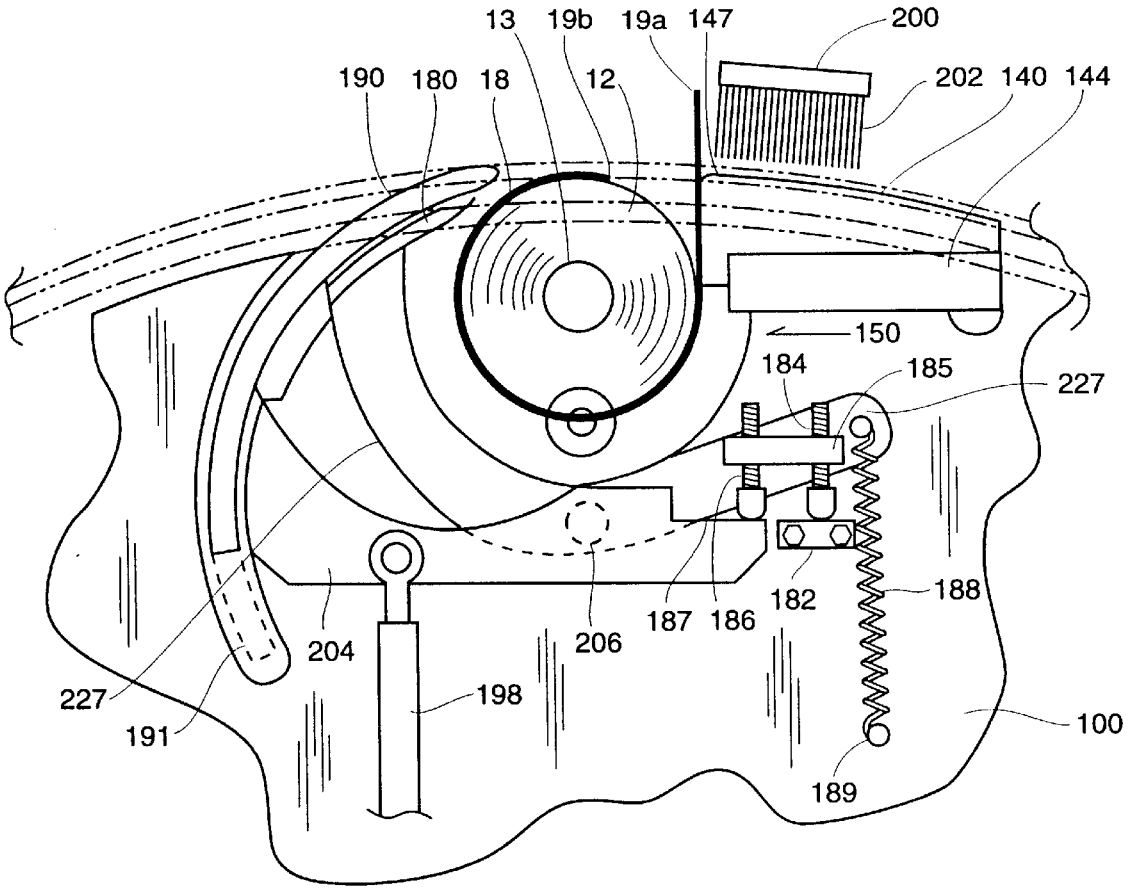
FIG. 4 is a detailed front elevational view of a pocket.

As the carousel 100 continues to rotate and after the workpiece 12 has fully entered the pocket 150, a clamp plate 180 shown in FIG. 4, driven by an underfolder plate linkage 192, clamps the workpiece 12 and wrapping film sheet 18 firmly into the pocket 150. After further carousel rotation, an underfolder plate 190 passes upward and across the opening 152 in the pocket 150 where the wrapping film sheet 18 and workpiece 12 are now located. As the underfolder plate 190 moves up and across the opening 152, the trailing wrapping film portion 19b is directed upward and completely over the workpiece 12.

The clamp plate 180 and underfolder plate 190 are driven by an underfolder plate linkage 192. The linkage 192 includes an underfolder cam 194, cam followers 196, connecting rods 198, underfolder arms 204, clamp arms 227 including internal ear 185, stop blocks 182, clamp plate screws 184, underfolder plate screws 186, pins 189, and springs 188.

The underfolder cam 194 is fixed to the frame 30 adjacent the rotating carousel 100. The cam 194 does not rotate. For each pocket 150, a cam follower 196 rides in cam 194. Each cam follower 196 is connected to a connecting rod 198 that extends to the corresponding underfolder arm 204.

On the carousel 100 at each pocket 150, an underfolder arm 204 pivots at pivot point 206. The rotation of carousel 100 around non rotating cam 194 moves connecting rod 198 which in turn moves arm 204 and underfolder plate 190 through an arc around pivot 206 and across pocket opening 152. FIG. 4 shows the underfolder plate 190 partially through its arc. Dotted lines 191 show its position before beginning to move through its arc. The motion of underfolder arm 204 and plate 190 also controls the motion of clamp plate 180, which pivots about pivot point 206 by means of clamp arm 227. Clamp plate 180 has two functions and derives its motion by the same cam system which moves underfolder plate 190 through its prescribed arc. The functions accomplished by clamp plate 180 are to firmly clamp workpiece 12 and wrapping film sheet 18 into pocket 150 and to snugly hold the trailing wrapping film portion 19*b* against workpiece 12 to insure a tight wrap of film 18 around workpiece 12.

Underfolder plate 190 also moves through its arc around the same pivot 206 and derives its motion from underfolder arm 204. When underfolder plate 190 is located in its fully retracted position 191 about pivot 206 clamp plate 180 is also fully retracted from workpiece 12, since it also moves through its arc around the same pivot 206, and derives its motion from underfolder arm 204 by means of clamp arm 227, stop block 182, clamp plate screw 184, internal ear 185, underfolder plate screw 186 and surface 187.

In its fully retracted position 191, screw 186 bears against surface 187 of underfolder arm 204, screw 184 is retracted from stop block 182, and spring 188 is fully extended. One end of spring 188 is connected to carousel 100 by pin 189. The other end is connected to clamp arm 227. Stop block 182 is mounted to carousel 100. Ear 185 is part of arm 227. Since screw 186 is held against surface 187 through the tension of spring 188, as underfolder arm 204 begins moving through its arc, clamp arm 227 also begins to move. As underfolder arm 204 continues through its arc, clamp plate 180 contacts workpiece 12 and wrapping film sheet 18 and snugly clamps them into pocket 150 by the force derived by the external spring 188. As arm 204 continues through its arc, clamp plate 180 and clamp arm 227 stop moving forward, either by plate 180 squeezing against workpiece 12 or by screw 184 bumping against stop block 182. When the clamp plate 180 has stopped moving, underfolder plate 190 continues moving through its full arc and finishes its function of folding trailing portion of wrapping film 18 against workpiece 12.

The underfolder plate 190 and clamp plate 180 hold the trailing wrapping film portion 19*b* snugly against the workpiece 12 so that there are no air pockets or gaps between the wrapping film sheet 18 and the workpiece 12. Once the trailing edge 19*b* is folded over the workpiece 12, the underfolder plate 190 begins to retract to avoid contact between the underfolder 190 and brush 200, idler rollers 212, and sealing drum 400.

The brush 200 is mounted to the wrapping machine frame 30 such that its bristles 202 contact the outer diameter surface of the rotating carousel 100. When each carousel pocket 150 arrives at the location of the brush 200, the remaining exposed wrapping film end or leading portion 19*a* is brushed over the trailing portion 19*b* of the wrapping film by the brush bristles 202 to form the lap 18*a*. Immediately prior to the brush 200 coming into contact with the leading portion 19*a* of the wrapping film sheet 18, ports 147 of vacuum block 140 expel a jet of high pressure air normal to the circumference of the carousel 100. The ports 147 are located upon the vacuum block 140 intermediate the leading edge 19*a* of the sheet 18 and the pocket 150. The jet of air from ports 147 releases the leading edge 19*a* from the vacuum block 140 and pushes it into an upright position normal to the carousel 100. The leading edge 19*a* is maintained in this position by the low pressure zone adjacent the high pressure air jet that is typical of the Venturi effect. The purpose of the jet of air is to ensure that the brush 200 removes all wrinkles and air pockets before the leading edge 19*a* is lapped over the trailing edge 19*b* of wrapping film sheet 18. The wrapping film sheet 18 is now fully banded in a cylindrical fashion around the outer circumference of the workpiece 12. The side edges of the wrapping film sheet extend outward a predetermined distance beyond the flat circular parallel sides of the workpiece 12.

A sealing belt 210 is supported on a pair of idler rollers 212 and a drive roller 216, the respective rollers all being mounted to a top sealer frame 214 which is positioned over the top portion of the wrapping machine 10 and which is firmly attached to the wrapping machine frame 30. The sealing belt 210 conforms to a top portion of the circumference of the carousel 100 and keeps the ends 19*a* and 19*b* of the wrapping film sheet 18 firmly lapped over one another in a tube configuration until the lap 18*a* is sealed by sealing rollers 504. When the pocket 150 containing the banded workpiece 12 first comes into contact with the belt 210, the underfolder plate 190 partially retracts but the clamp plate continues clamping the banded workpiece 12 into the pocket 150. The belt 210 comes into contact with the exposed portion of the wrapping film sheet 18 including the lap 18*a*. The lap 18*a* of the film wrapping sheet 18 is held firmly together by the sealing belt 210. The sealing belt 210 may be made from TEFLON or other suitable heat resistant and non-stick material. To ensure that the sealing belt 210 travels at a constant velocity, the belt 210 is provided with registration holes (not shown) that mate with the teeth of drive roller 216. Drive roller 216 drives the sealing belt 210 at a predetermined linear velocity that matches the linear velocity of each pocket 150 of the carousel 100. In order to maintain the proper tension upon sealing belt 210, the belt 210 is passed through idler rollers 218. Idler rollers 218 are connected to the top sealer frame 214 by spring tensioner 220.

Power for driving the sealing belt 210 and the sealing drum 500 is provided by gearbox 222 which may be alternatively powered by motor 92 through a drive shaft coupled to gearbox 222 or by a separate motor mounted atop the frame 30. If a separate motor is to be used to power the sealing belt 210 and the sealing drum 500, it is essential to provide means for synchronizing the operation of the separate motor with motor 92 so that the sealing belt 210 and the sealing drum 500 will have the appropriate relative motion. Gear box 222 in turn mounts upon a single shaft drive rollers 226 and 228. Toothed drive roller 226 is situated to drive sealing belt 210 through drive belt 230,the registration holes of belt 230 mating with the teeth of drive roller 216. The toothed drive roller 228 is situated to impart rotary motion to the sealing drum 500 through drive belt 232 which powers drive roller 234, drive roller 234 being fixed to the driven shaft 502 of sealing drum 500. Drive belts 230 and 232 are further supported by idlers 236 and 238, respectively. Idlers 236 and 238 are supported upon idler bracket 240 affixed to the wrapping machine frame 30.

When a pocket 150 containing a banded workpiece 12 reaches the 12'clock position on the carousel 100, the lap 18*a* of the wrapping film sheet 18 is heat sealed together by sealing drum 500. As is described above and shown in FIG. 5, the shoulder piece 164 of the side folders 160 support the excess wrapping film 18 that extends beyond the ends of the workpiece 12. The sealing roller pads 165 mounted upon the shoulder pieces 164 support the excess wrapping film 18 extending beyond the ends of the workpiece 12 at the same level as that of the wrapping film 18 wrapped about the body of the workpiece 12. Additionally, the sealing roller pads 165 provide a resilient support for the lap 18*a* when the sealing roller 504 is pressed down upon the lap 18*a* in order to secure the ends 19*a* and 19*b* of wrapping film sheet 18 about workpiece 12 into a contiguous tube of wrapping film sheet 18.

The sealing drum 500 that accomplishes this sealing step is essentially comprised of a pair of electrically heated sealing rollers 504 that orbit about driven shaft 502. Driven shaft 502 is supported by a pair of bearings 503 that are attached to the top sealing frame 214. It is important to note that the sealing of the wrapping film sheet 18 about the workpiece 12 is a function of time, pressure, and heat, i.e., the efficacy of a sealing operation is based upon the amount of time the sealing roller 504 is pressed against the workpiece 12, the magnitude of the pressure with which the sealing roller 504 is applied to the workpiece 12, and the temperature of the sealing roller 504 as it is applied to the workpiece 12. If the total amount of contact time is reduced in the sealing step, then the temperature of the sealing roller must be raised and/or the amount of pressure applied to the workpiece 12 by the sealing roller 504 must be increased. Conversely, if the temperature of the sealing roller 504 is raised, then the total sealing time may be decreased and/or the pressure applied to the workpiece 12 by the sealing roller 504 may be decreased.

Figure 6:
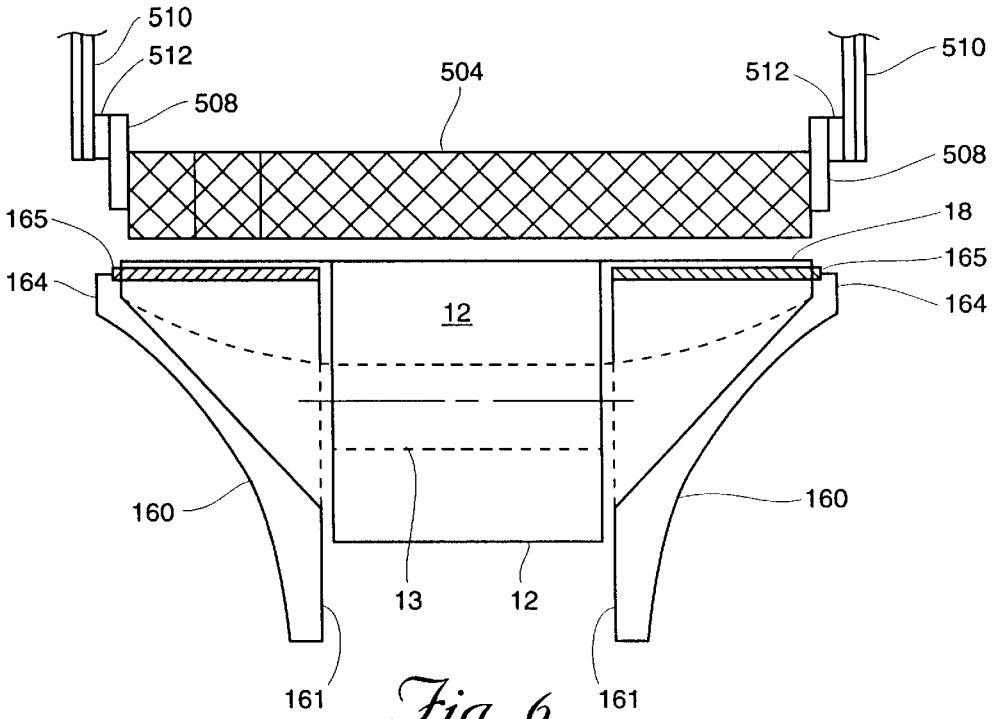
FIG. 6 is a schematic view showing the sealing roller, mounting bars, insulators, slide bars, and the workpiece as the wrapping film is being sealed about the workpiece.
Figure 7:
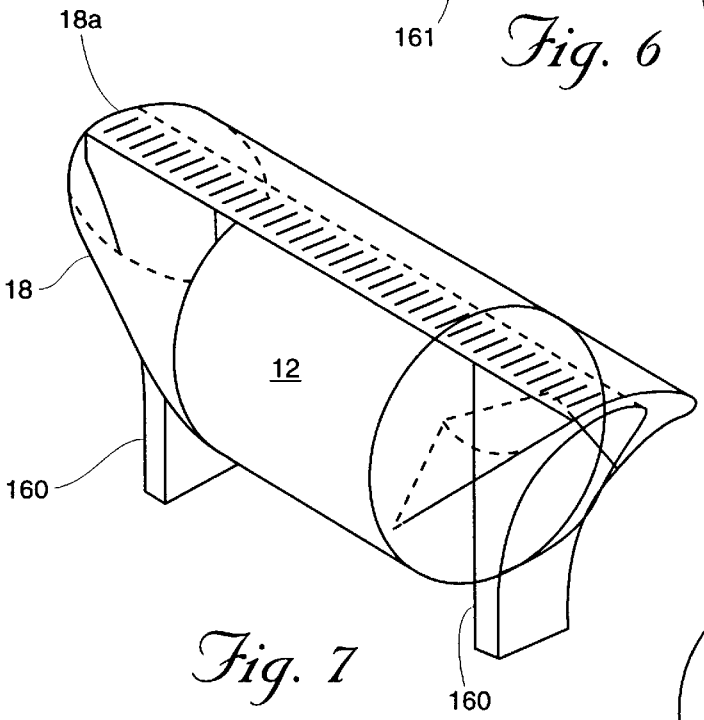
FIGS. 7–8 are schematic views showing how the excess wrapping film is supported by the shoulder piece of the stationary side folder for sealing purposes.
Figure 8:
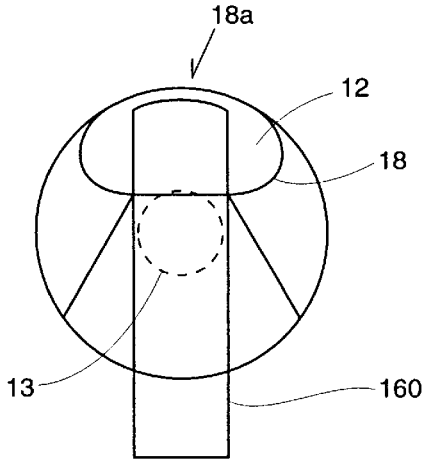
Figure 11:
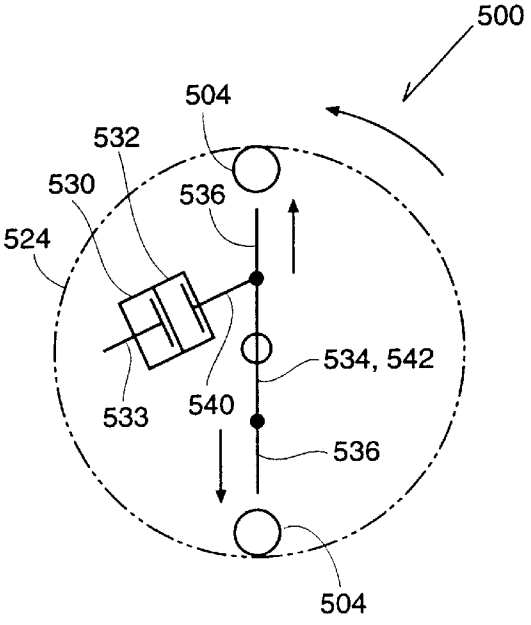
FIGS. 9–11 are schematic views of the sealing drum showing the manner in which the sealing rollers are moved so as to alter the radius of the sealing drum.

As time is the major variable in the paper production industry, given that the rate with which workpieces 12 pass through the film wrapping machine 10 may vary throughout a work day, means have been provided by which the sealing rollers 504 may be applied at the correct time-pressure-temperature relationship. Referring to FIGS. 1 and 6, it can be seen that a pair of drum side plates 506 are fixedly mounted upon driven shaft 502. The drum side plates 506 are spaced apart slightly wider than the width of the sealing rollers 504, as sealing rollers 504 are mounted at 180° to one another between the drum side plates 506. Each sealing roller 504 is supported at each of its respective ends by a mounting bar 508. The mounting bars 508 extend beyond the circumference of each sealing roller 504. In turn, each of the mounting bars 508 is fixedly connected to a slide bar 510. An insulator 512 is placed between the mounting bars 508 and the slide bars 510 at the point of connection between the two. The insulator 512 serves to prevent unwanted heat energy from traveling through the slide bars 510 to the v-rollers 514 upon which the slide bars 510 are mounted. A plurality of v-rollers 514 are mounted to the drum side plates 506 so as to sidably support the slide bars 510 of the sealing rollers 504. The v-rollers 514 have female, v-shaped circumferential edge cross sections arranged to receive the male v-shaped edge cross sections of the longitudinal edges of each slide bar 510. The v-rollers 514 slidably receive each slide bar 510 with at least two of v-rollers 514 located on one side of the slide bar 510 and at least one other v-roller 514 located on the other side of the slide bar 510 so as to oppose the first two v-rollers 514. As indicated above, the sealing rollers 504 of the sealing drum 500 are mounted 1800 from each other, thereby defining the radius of the sealing drum 500 as it spins about driven shaft 502. Because the sealing rollers 504 are sidably mounted within the drum side plates 506 on v-rollers 514, the radius of the sealing drum 500 can be readily altered. Altering the radius of the sealing drum 500 is a means for achieving the correct time-pressure-temperature relationship in the sealing procedure. This means is more fully described below.

As the sealing drum 500 rotates on driven shaft 502, the sealing rollers 504 are constrained to orbit driven shaft 502. The radial velocity of the sealing rollers 504 is critical as a sealing roller 504 must precisely contact the lap 18*a* of the wrapping sheet film 18 on each workpiece 12 contained in the pockets 150 in order to properly secure the wrapping sheet film 18 about the workpiece 12. As can be seen in FIG. 1, sealing drum 500 is situated within sealing belt 210 and is driven by the same gearbox 222 as is the sealing belt 210. By carefully specifying the correct diametric ratios between the sheaves 226 and 216 and 234 respectively, the sealing drum 500 will be constrained to rotate at a rate such that a sealing roller 504 will contact the lap 18*a* of each workpiece 12 as the centerline of each pocket 150 containing the workpiece 12 crosses a line drawn between the axis of rotation of the sealing drum 500 and the carousel 100. As the workpiece 12 reaches the predetermined sealing position, a sealing roller 504 is brought into indirect contact with the lap 18*a* of the film wrapping sheet 18 (FIG. 6). The sealing belt 210 is interposed between the sealing roller 504 and the workpiece 12. Heat from the sealing roller 504 is conducted through the sealing belt 210, melting, and thereby sealing together, the lap 18*a* of the film wrapping sheet 18. The indirect contact between the sealing roller 504 and the workpiece 12 is momentary as the rotation of the carousel 100 and the sealing drum 500 rapidly move the roller 504 and the workpiece 12 apart. The temperature of the sealing rollers 504, and hence the amount of heat applied to the workpiece may be controlled electronically, by means of a thermistor 576. As the temperature of the sealing rollers 504 may not be instantaneously changed, it is preferred to maintain the temperature of the sealing rollers 504 at a constant level.

Figure 10:
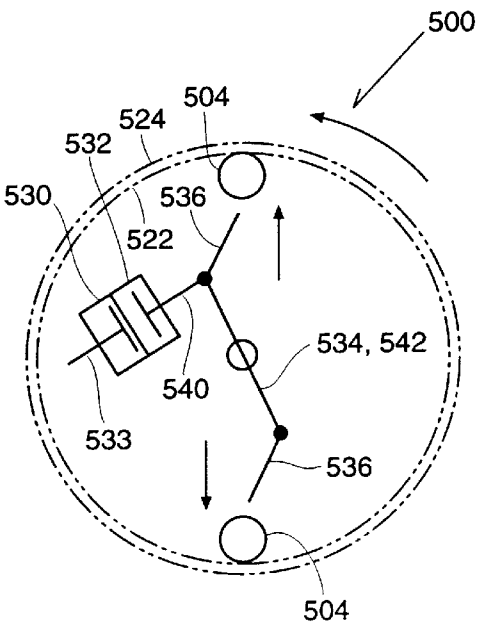
Figure 9:
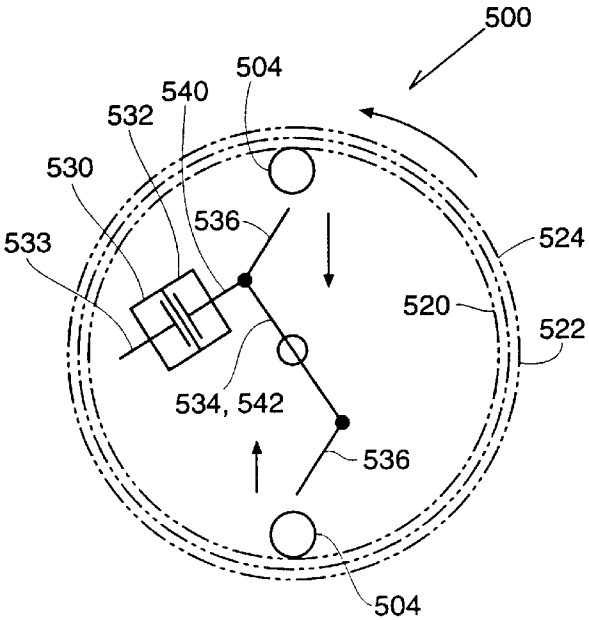

Because the rate at which the film wrapping machine 10 is operating dictates the time variable in the time-pressure-temperature relationship involved in sealing the lap 18*a* of the film wrapping sheets 18 together, it is preferred to control the pressure variable. As mentioned above, the radius of the sealing drum 500 can be altered. Controlling the radius of the sealing drum 500 is the preferred method for controlling the pressure at which the sealing rollers 504 contact the workpieces 12. In this embodiment, three different radii are selectable depending upon the rate at which the film wrapping machine 10 is operating, though it is to be understood that near infinite variation upon these radii is possible. The smallest radius maintained by the sealing rollers 504 of the sealing drum 500 is indicated by the dashed line labeled 520. At this radius of operation, the sealing rollers 504 are fully retracted from the sealing belt 210 and no contact occurs between them. When the film wrapping machine 10 is operating without workpieces 12 in pockets 150, the sealing rollers 504 will be retracted to radius 520. When the film wrapping machine 10 is operating at slower rates in the range of 100 units per minute, the radius of the sealing drum 500 will be adjusted to an intermediate radius, indicated in FIGS. 9–10 by dashed line 522. At higher rates of operation in the neighborhood of 200 units per minute, the radius of the sealing drum will be fully extended to the radius indicated by dashed line 524. By altering the radius of the sealing drum 500, the pressure component of the time-pressure-temperature sealing relationship can be altered.

When the sealing drum 500 is at radius 522, the sealing rollers 510 place pressure upon the workpieces 12, thereby deforming slightly the resilient workpieces 12. As is true of all resilient materials, the amount of pressure experienced by the workpieces 12 is directly related to the depth to which the workpieces 12 are deformed. Because the sealing rollers 504 are rigid and the workpieces 12 relatively elastic, the amount of deformation and hence pressure, placed upon the workpieces 12 is a function of the radius of the sealing drum 500. Increasing the radius of the sealing drum 500 to radius 524 increases the deformation of the workpieces 12 and hence increases the pressure experienced by the workpiece 12. It is important to increase the pressure between the sealing rollers 504 and the workpieces 12 as the time of contact between them decreases. The increased pressure improves the conduction of heat between the sealing rollers 504 and the film wrapping sheet 18 of the workpiece 12 and ensures that the lap 18*a* of sheet 18 is sufficiently melted and pressed together so as to form a satisfactory seal. Where the temperature of the sealing rollers 504 is kept at a constant by use of the thermistors 576 (not shown), the general relationship between sealing time and pressure is that where the time of contact decreases, there must be a corresponding increase in the contact pressure to ensure a proper seal. In this instance, when the wrapping machine 10 operates at an intermediate speed of approximately 100 pieces per minute, the radius of the sealing drum 500 is indicated by dashed line 522 and where the wrapping machine 10 is operating at a high speed of approximately 200 pieces per minute, the radius of the sealing drum 500 is indicated by the dashed line 524.

Alteration of the radius of the sealing drum 500 is accomplished through the use of two cooperating electrically actuated air cylinders 530 and 532, coupled to a pivot arm 542 that actuates a pair of pivot bars 534, all of which are rotatably mounted upon driven shaft 502. The pivot bars 534 are in turn coupled to a plurality of connecting links 536 that change the linear position of slide bars 510 and ultimately alter the radius of the sealing drum 500. The air cylinders 530 and 532 are mounted back-to-back such that the lengths of their strokes are additive. Piston 540 of air cylinder 532 is coupled to pivot arm 542. Pivot bars 534 and pivot arm 542 are connected to one another and constrained to rotate about driven shaft 502 in like manner by pivot rod 544. When pistons 533 and 540 of air cylinders 530 and 532 respectively, are retracted, the ends of the pivot bars 534 are rotated away from the sealing rollers 504, causing connecting links 536 to move slide bars 510 and sealing rollers 504 radially inward. When both pistons 533 and 540 are retracted, the sealing rollers 504 are fully retracted and sealing drum 500 approximates the radius indicated by dashed line 520. By extending piston 540 of air cylinder 532, the ends of pivot bars 534 are rotated towards the sealing rollers 504, causing connecting links 536 to move slide bars 510 and sealing rollers 504 radially outwardly. With piston 540 extended and piston 533 retracted the sealing drum approximates the radius indicated by dashed line 522. This radius of operation is suitable for sealing film wrapping sheets 18 on workpieces 12 at low rates of operation. When both pistons 533 and 540 are extended, the radius of the sealing drum 500 approximates the radius indicated by dashed line 524. This larger radius of operation is suitable for sealing film wrapping sheets 18 on workpieces 12 at high rates of operation.

Compressed air for operating air cylinders 530 and 532 enters the rotating sealing drum 500 through air access bore 550 (not shown) formed into an end of driven shaft 502. Air lines 552 from a source 142*a* of compressed air are attached to a rotating air fitting 554 (not shown) that is mounted upon the end of the driven shaft 502 having air access bore 550. Air lines 556 (not shown), receiving compressed air from the air access bore 550 through port 557, provide air to a pair of electrically activated solenoid air valves 558 and 560 that are fixedly mounted to one of the drum side plates 506. Air lines 562 (not shown) provide air from solenoid valves 558 and 560 to air cylinders 530 and 532, respectively.

Electrical access to the rotating sealing drum 500 for activating solenoid air valves 558 and 560 and operating the sealing rollers 504, is provided in the same manner as compressed air is provided to the sealing drum 500. An electrical access bore 570 (not shown) is formed into the end of driven shaft 502 opposite the end containing air access bore 550. An electrical slip ring fitting 572 (not shown) is mounted to the opening of electrical access bore 570. A port 574 (not shown) formed through the side of the driven shaft 502 is in communication with the interior of the electrical access bore 570 and provides a means for passing conductors from the slip ring fitting 574 to the interior of the sealing drum 500. In order to power all of the components of the present embodiment of the sealing drum 500, a total of eleven electrical connections (not shown) need be supplied through the slip ring fitting 572 to the interior of the sealing drum 500, though it should be understood that the number of electrical connections might vary from the presently indicated eleven without straying from the present invention. Four of the eleven electrical connections are dedicated to a pair of thermistors 576, one of each being mounted to a separate sealing roller 504. The thermistors 576 permit the operator of the film wrapping machine 10 to monitor the temperature of the sealing rollers 504 and to adjust the temperature accordingly. The temperature of the sealing rollers 504 is controlled by four more of the electrical connections to the interior of the sealing drum 500 that are dedicated to a pair of heaters 578 located inside sealing rollers 504. Each heater 578 requires two connections. Two of the remaining conductors are control wires dedicated to one of the respective solenoid air valve 558 and 560. The eleventh electrical connection is the common ground wire for the electrical components of the sealing drum 500.

Figure 13:
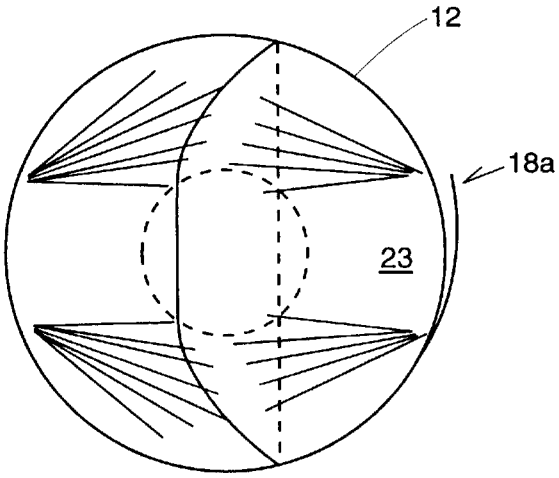

Referring to FIG. 1, once the wrapping sheet film 18 is banded and sealed about the workpiece 12, the carousel pocket 150 rotates to an exit conveyor 300 where a pair of upper and lower conveyor belts 302 and 304, having a fixed gap of adjustable dimension and moving linearly at the same rate as the rate of rotation of the carousel by means of a four bar linkage 306, grips each wrapped workpiece 12 as it is ejected by an ejector bar 290 within the pocket 150. Upper belt 302 and lower belt 304 pivot on their respective centers 307 and 308. The upper and lower belts 302 and 304 of the exit conveyor 300 are mounted to frame 311 (not shown) and are oscillated by one to one crank 309 through link 310 (not shown). This allows the centers of pulleys 312 and 313 to match, for an instant, the constant speed of each pocket 150 in carousel 100 and allows ejector bar 290 (FIG. 16) to timely push the wrapped workpiece 12 into the exit conveyor 300. Mounted between the upper and lower conveyors 302 and 304 are a pair of side folder guide plates 303. The side folder guide plates 303 pivot about point 309 and oscillate in time with the upper and lower belts 302 and 304. Furthermore, by means of a three-bar linkage 316, the side folder guide plates 303 maintained in a parallel relation to the upper and lower belts 302 and 304. As the workpieces 12 are ejected from the pockets 150 and moved down the oscillating exit conveyor 300 between upper and lower belts 302 and 304, the side folder plates 303, arranged in alignment with the stationary side folders 160, fold a second quadrant 23 (FIG. 13) of the excess film wrapping sheet 18 towards the core 13 of the workpiece 12. This second fold is aligned 180° away from the first fold made by the stationary side folders 160 and laps over the first fold leaving two "ears" that will be folded towards the center or core 13 of the workpiece 12 as described below.

Each ejector bar 290 of each pocket 150 is actuated by an ejector bar cam 292. The cam 292 is mounted parallel to the carousel 100 by means of bracketing which is fixed to frame 30. The cam 292 is stationary and does not rotate. The first end of a connecting rod 294 is connected to the ejector bar 290 and is guided by linear bearing 295. The opposite end is connected to a cam follower 296 which rides in cam 292. When a rotating carousel pocket 150 comes into alignment with the exit conveyor 300, the ejector bar 290 and connecting rod 294 are pushed outward by the cam follower 296 which rides in the cam 292. The wrapped workpiece 12 is ejected into exit conveyor 300 between belts 302 and 304.

Figure 17:
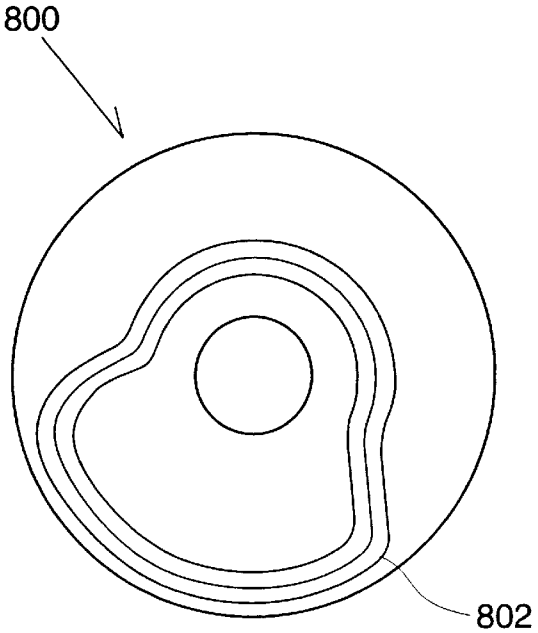
FIG. 17 is a front elevational view of the ejector bar cam.
Figure 16:
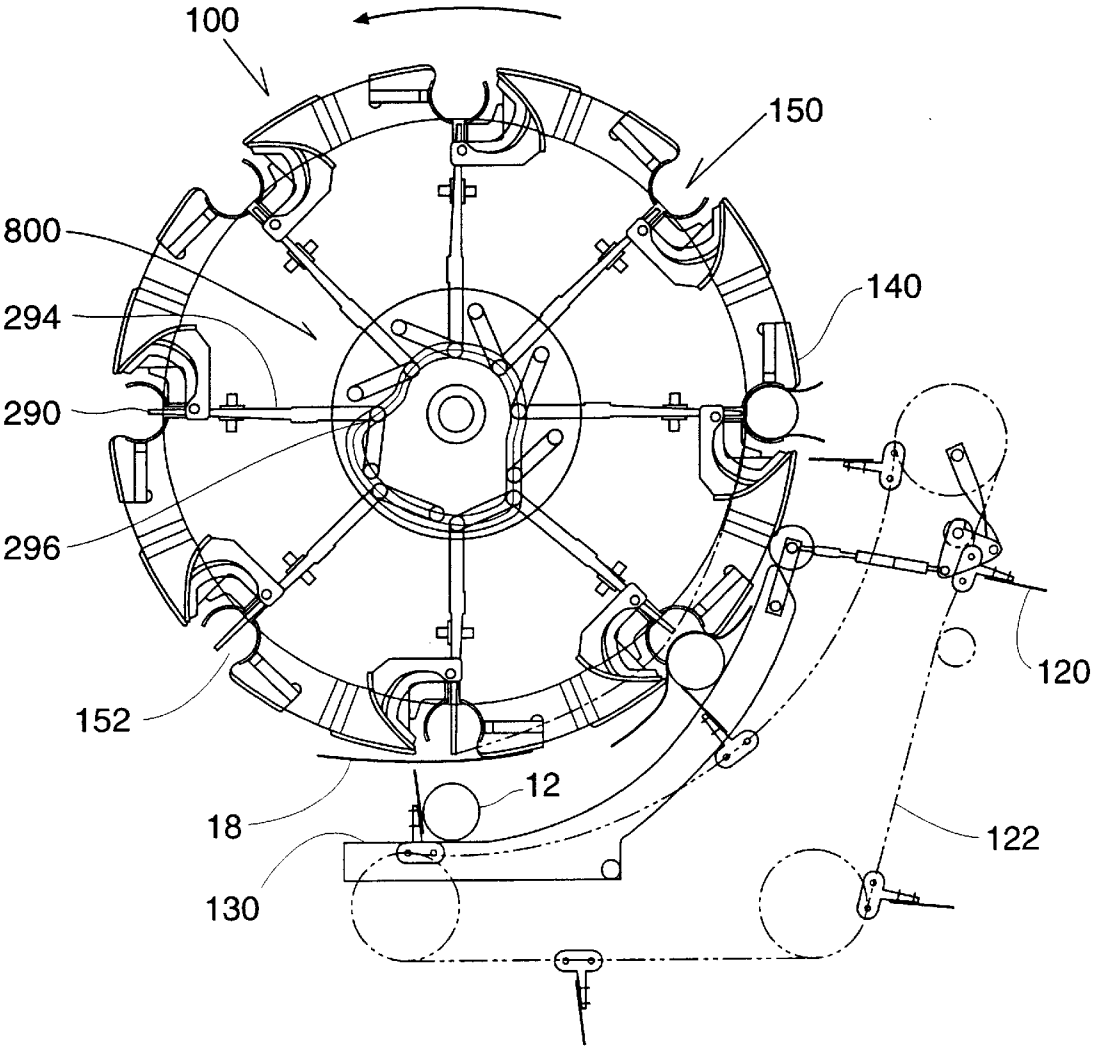
FIG. 16 is a front elevational view of the back side of the rotating carousel.

Referring to FIGS. 16 and 17, an alternative ejector bar cam 800 having cam path 802 is shown. Utilizing cam 800, ejector bar 290 remains in its fully extended state after the workpiece 12 has been ejected onto exit conveyor 300. As the carousel 100 continues to rotate, a new workpiece 12 and sheet of wrapping film 18 are ramped into pocket 150 through pocket opening 152 by the ramp 130 and flight bar 120. As the workpiece 12 is pushed up the ramp 130 by the flight bar 120, ejector bar 290 comes into contact with the workpiece 12 having the wrapping film 18 trapped there between. As the workpiece 12 continues its path into the pocket 150, ejector bar 290 applies a slight pressure on the workpiece 12 and the wrapping film 18. Ejector cam bar path 802 exactly matches the ramp 130 path. The slight pressure applied by the ejector bar 290 to the wrapping film 18 and workpiece 12 prevents the workpiece 12 from rotating or rolling as it is pushed through pocket opening 152 of pocket 150. The ejector bar 290 also prevents wrapping film 18 from slipping or becoming misaligned within pocket 150. This results in the leading portion and trailing portion of wrapping film sheet 18 extending out of the pocket opening 152 at the same length. Accordingly, a consistent lap is produced at the same location as the carousel 100 continues to rotate.

The conveyor belts 302 and 304 carry the wrapped workpiece 12 to a discharge conveyor 320. In the preferred embodiment of this invention, the conveyor belts 302 and 304 are comprised of a plurality of flexible bands 318 running in circular grooves formed into the pulleys supporting the belt. Likewise, conveyor belts 322 and 324 of the discharge conveyor 320 are also comprised of a plurality of flexible bands 318 running in circular grooves 317 formed into the pulleys supporting the conveyor 320. This type of conveyor belt is commonly known as "eagle belting" and is available from Eagle Belting of Des Plaines, Ill. As can be seen in FIG. 1, drive pulleys 314 and 315 are shared between the exit conveyor 300 and the discharge conveyor 320. Drive pulleys 314 and 315 have twice as many circular grooves 317 so as to accommodate twice as many flexible bands 318. The use of interlocking eagle belting as described above in lieu of standard web belting essentially creates a seamless junction between the exit conveyor 300 and the discharge conveyor 320, ensuring that the passage of wrapped workpieces 12 from the exit conveyor 300 to the discharge conveyor 320 is not adversely affected by differing belt speeds at the junction between the two conveyors, a circumstance that could cause damage to the workpieces 12.

The discharge conveyor 320 is comprised of an upper conveyor 322 and a lower conveyor 324 adjustably mounted parallel to one another within frame 311. The discharge conveyor 320 receives workpieces 12 from the exit conveyor 300 and transports them to a sealing conveyor 350.

Figure 14:
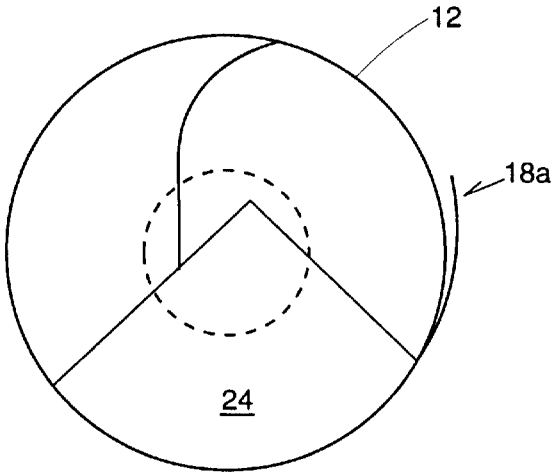
Figure 15:
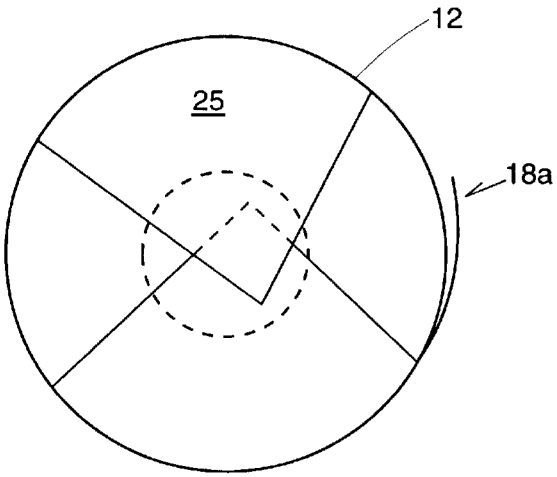

The discharge conveyor 320 also has one pair of side up-folder plates 326 and one pair of down-folder plates 328 mounted between the upper and lower conveyors 322 and 324 and aligned with the side folder guide plates 303 of the exit conveyor 300. The up- and down-folder plates 326 and 328 are affixed to the frame 311 in such a manner as to maintain a gap of approximately 0.125 inches between the ends of workpieces 12 as they travel through the discharge conveyor 320. The up-folder plates 326 are positioned within the discharge conveyor 320 adjacent the exit conveyor 300 and are comprised of a triangular plate 327 having its hypotenuse forming an acute angle with the direction of flow of the workpieces 12. As the workpieces 12 move into the discharge conveyor 320, the lower quadrants 24 or "ears" (FIG. 14) of the excess wrapping film 18 extending beyond each end of the workpieces 12 are folded upward toward the centers of the workpieces 12 by the ramp action of the stationary up-folder plates 326. The close proximity of the up- and down-folder plates 326 and 328 to the ends of the workpieces 12 retains the folded quadrants against the end of the workpiece 12. When the workpieces have traveled approximately half of the length of the discharge conveyor 12, the remaining quadrants 25 or "ears" (FIG. 15) of the excess wrapping film 18 extending beyond each end of the workpieces 12 come into contact with the pair of down-folder plates 328 which folds quadrant 25 downward toward the center of the end of the workpiece 12 in precisely the same manner as the up-folder plates 326 described above. The workpiece 12, having the quadrants 22, 23, 24, and 25 of excess wrapping film 18 neatly folded to its ends, is then transported to the sealing conveyor 350 where heat is applied to the ends of the workpieces 12 to seal the quadrants 22, 23, 24, and 25 to one another, thereby securing the wrapping film sheet 18 to the workpiece 12 and creating an air and water proof seal.

Figure 18:
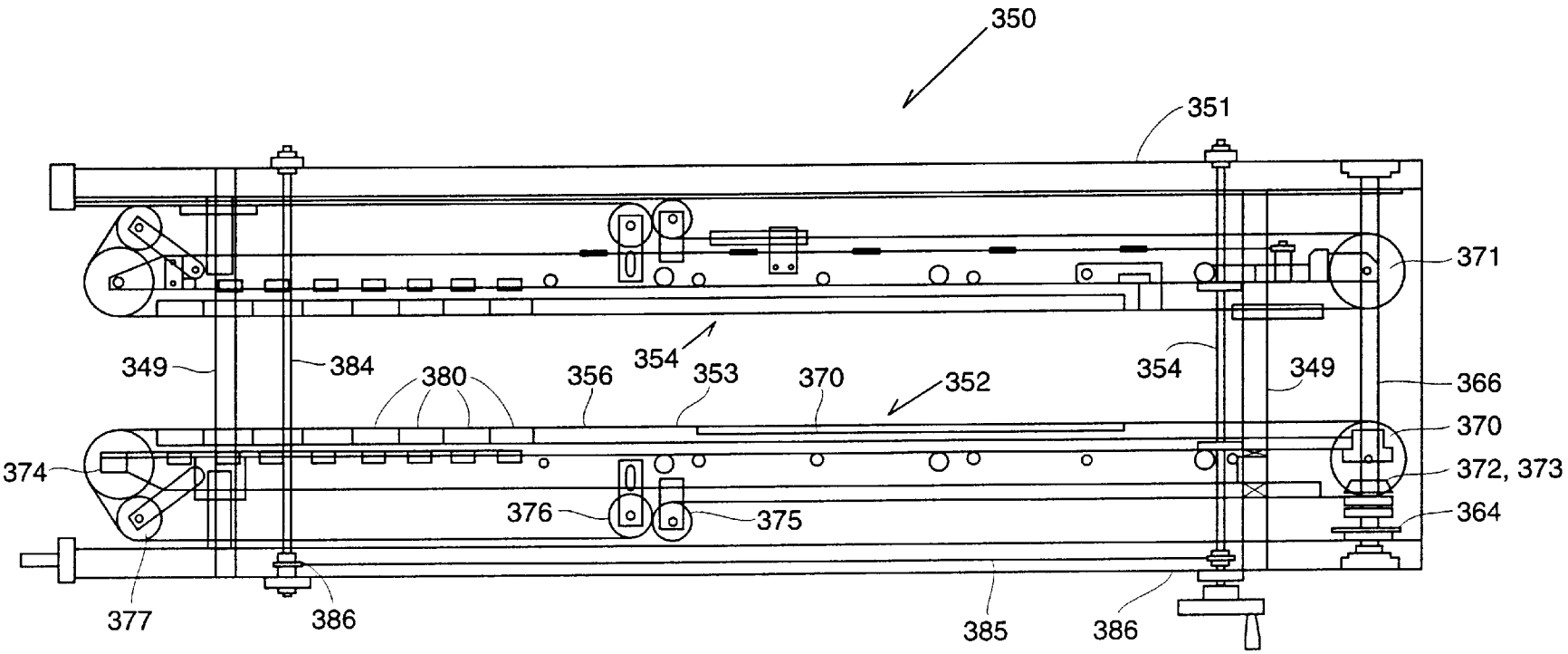
FIG. 18 is an overhead plan view of the sealing conveyor.

As can be seen in FIGS. 1 and 18, the sealing conveyor 350 is comprised of two vertically oriented sealing conveyors 352 and 354 arranged so as to form an open channel. The sealing conveyor 350 is located immediately adjacent the discharge conveyor 320 so as to receive the workpieces 12 as they exit the discharge conveyor 320. As workpieces 12 exit the discharge conveyor 320 the workpieces 12 are gripped at their ends between vertical sealing conveyors 352 and 354. The vertical sealing conveyors 352 and 354 are movably mounted in a frame 351 upon mounting bars 349. The sealing conveyors 352 and 354 are arranged in a vertical fashion and spaced apart upon mounting bars 349 so as to firmly contact the sides of the workpieces 12 as they exit the discharge conveyor 320. Vertical sealing conveyors 352 and 354 are moveable relative to one another upon mounting bars 349 and maintain a parallel relationship to each other and to the centerline of the sealing conveyor 350. Relative movement between the conveyors 352 and 354 is controlled in this embodiment by threaded rods 384. Threaded rods 384 have at each respective end oppositely oriented threads such that when the rods 384 are threaded into each of the vertical sealing conveyors 352 and 354, spinning of the rods causes the vertical sealing conveyors 352 and 354 to move upon the mounting bars 349 relative to each other and to move symmetrically to the centerline of the sealing conveyor 350. The threaded bars 384 are connected by chain 385 which rides on identical sprockets 386 on the respective threaded bars 384. When one of the threaded bars 384 is turned, the other threaded bar 384 is constrained to rotate the same amount, thereby ensuring that the vertical sealing conveyors 352 and 354 are maintained in parallel relation to one another. The adjustment permitted by the threaded bars 384 is necessary to compensate for variations in workpiece 12 size.

The vertical sealing conveyors 352 and 354 are powered by an electric motor 358 coupled to a gearbox 360, both mounted beneath the frame 351. The gearbox 360 spins sprocket 362 which is in turn coupled to sprocket 364 affixed to common shaft 366 by chain 368. The common shaft 366 is supported by frame 351 and provides power to both vertical sealing conveyors 352 and 354. Motive power is transferred to the respective drive rollers 370 and 371 of vertical sealing conveyors 352 and 354 from shaft 366 by miter gears 372 mounted upon the shaft 366. Miter gears 372 mate with miter gears 373 affixed to drive rollers 370 and 371, respectively.

The structures of the vertical sealing conveyors 352 and 354 are substantially identical excepting that the conveyors 352 and 354 are mirror images of each other. Hence, only the structure of vertical sealing conveyor 352 will be described herein. As described above, the vertical sealing conveyor 352 is movably mounted to frame 351 upon mounting bars 352. Its belt 353 comprises an inner vertical face of the channel of the sealing conveyor 350 and is driven by electric motor 358 through drive roller 370. In this embodiment, the drive roller 370 is located upon the exit side of the sealing conveyor 350 but it must be understood that the sealing conveyor 350 could be arranged such that the drive roller 370 would be located on the entrance side of the sealing conveyor 350 without departing from the instant invention. Belt 353 is preferably fabricated from a heat resistant, non-stick material. One such material is commonly known as TEFLON. The material from which belt 353 is fabricated must also be highly conductive to heat without being adversely affected by the heat. Belt 353 runs on and is supported by drive roller 370, driven roller 374, stationary tensioner roller 375, adjustable tensioner roller 376, and spacer roller 377. The length of the belt 353 extending between the driven roller 374 and the drive roller 370 represents the working surface of the vertical sealing conveyor 352 and, together with vertical sealing conveyor 354, serves to transport the workpieces 12 through the sealing conveyor 350. In this embodiment belt 353 travels from the driven roller 374 towards and around the drive roller 370. As the belt travels from the drive roller 370 toward the driven roller 374 it passes behind a stationary tensioner roller 375, over an adjustable tensioner roller 376, and over a spacer roller 377, before traveling around the driven roller 374 and back toward the drive roller 370. The tension of the belt 353 is controlled by adjusting the position of the adjustable tensioner roller 376. Moving the adjustable tensioner roller in a direction normal to the travel of the belt 353 and into the belt 353 will increase the tension of the belt 353 whereas moving the adjustable tensioner roller 376 away from the belt 353 will decrease the tension of the belt 353. In this embodiment it is preferred to utilize a tensioner roller 376 that is mounted in a quick release fashion such that solely by actuating a handle coupled to the tensioner roller 376, the tension of the belt 353 can be released or set.

The span 356 of belt 353 between the driven roller 374 and the drive roller 370 is supported by sealing plates 380 and cooling plates 382. As there are no additional supporting rollers between the driven roller 374 and the drive roller 374 these plates 380 and 382 serve a dual function. First, the heating and cooling plates 380 and 382 support belt 353 in the span 356 between driven roller 374 and drive roller 370 and permit the belt 353 to exert sufficient pressure upon the workpieces 12 being moved through the sealing conveyor 350. The plates 380 and 382 are resiliently mounted within the vertical sealing conveyor 352 and are in planar contact with the belt 353 of the vertical sealing conveyor 352. The each of the plates 380 and 382 is biased by a spring element (not shown) into planar contact with the belt 353. The resilience of the spring element permits a sufficient force to be exerted upon the ends of the workpieces 12 without deforming the workpieces 12 as might occur if the plates were fixedly mounted within the vertical sealing conveyor 352.

The second function of the plates 380 and 382 are to heat and cool the film wrapping sheets 18 that are wrapped about each workpiece 12. The heating plates 380 support a first portion 357 of the span 356 of the belt 353. The heating plates 380 are electrically heated and conduct their heat energy through the belt 353 to the film wrapping sheets 18 wrapped and folded upon the ends of the workpieces in the sealing conveyor 350 so as to bring the film wrapping sheets 18 on the ends of the workpieces 12 to a predetermined temperature. This temperature is derived from the melting point of the particular material from which the wrapping film 15 is made and from the heat transfer characteristics between heating plates 380 and the ends of the workpieces 12 as the workpieces 12 move rapidly through the sealing conveyor 350. In this embodiment the temperature of the heating plates is set in the neighborhood of 375° F., though it is to be understood that this temperature may be adjusted up or down depending upon the speed with which the workpieces 12 travel through the sealing conveyor and the material from which the wrapping film sheets 18 are fabricated. The intention of heating the wrapping film 15 on the ends of the workpieces while under pressure from the belt 353 is to melt the wrapping film 15 just enough to make it adhere to itself. Heating the wrapping film 15 on the ends of the workpieces 12 to a higher temperature might result in the wrapping film 15 in sticking to the roll 14. As it is likely that without some sort of cooling means that the wrapped ends of the workpieces 12 will be slightly tacky when exiting the sealing conveyor 350, it is necessary to cool the ends of the workpieces before the workpieces exit the sealing conveyor 350. The cooling plates 382 support the remaining portion 359 of the span 357 and act as heat sinks for the heated wrapping film 15 on the ends of workpieces 12. Failing to properly cool the ends of the workpieces 12 prior to their exit from the sealing conveyor 350 might result in the wrapping film 15 of the workpieces 12 sticking together or in the wrapping film 15 sticking to other objects such as conveyors or packaging machinery. Just as heat was transferred to the ends of the workpieces by the heating plates 380, the cooling plates 382 remove heat from the wrapping film 15 of the workpieces 12 by simple heat conduction, the heat from the ends of the workpieces 12 moving through the belt 353 and to the cooling plates 382. The cooling plates 382 are in this embodiment simple heat sinks that work on the principles of heat transfer alone, however it is contemplated that the cooling plates 382 could be refrigerated by one means or another and thereby improve the heat transfer properties of the cooling plates 382. In the current embodiment the workpieces 12 emerge from the sealing conveyor warm to the touch but not warm enough for the wrapping film 15, now securely and neatly wrapped about the workpiece 12, to be tacky or runny.

The workpieces 12 exit the sealing conveyor 350 in a finished, wrapped state and are then passed to a packaging machine or other equipment for further processing. Though the present embodiment describes and illustrates a film wrapping machine 10 generally suited for the wrapping of toilet tissue rolls, it is to be understood that the present invention can be modified to accommodate larger or smaller rolls of various types of paper products without overstepping the bounds of the present invention.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An apparatus for wrapping workpieces, the apparatus comprising:

a frame structure;

a rotating carousel mechanism having a plurality of wrapping stations, the carousel mechanism coupled to the frame structure;

each wrapping station having a clamping mechanism, a single underfolding mechanism, and a pair of side folder mechanisms;

the clamping mechanism pivotally mounted to the carousel mechanism adjacent each wrapping station;

the underfolding mechanism pivotally mounted to the carousel mechanism adjacent each wrapping station and including an underfolder plate;

an underfolder arm, the underfolder arm being fixedly connected to the underfolder plate and pivotally connected to the carousel;

a camming mechanism for pivoting the underfolder plate, the camming mechanism connected to the underfolder arm;

the pair of side folder mechanisms fixedly mounted to the carousel mechanism adjacent each wrapping station; and a sealing drum rotationally mounted adjacent to the carousel.

2. An apparatus for wrapping workpieces, the apparatus comprising:

a frame structure;

a rotating carousel mechanism having a plurality of wrapping stations, the carousel mechanism coupled to the frame structure;

each wrapping station having a clamping mechanism, an underfolding mechanism, and a pair of side folder mechanisms;

the clamping mechanism pivotally mounted to the carousel mechanism adjacent each wrapping station and including a clamp plate;

a clamp arm having a first end, a second end, and a pivot point;

the first end connected to the clamp plate and the pivot point pivotally connected to the carousel mechanism;

a spring having two ends, the first spring end connected to the second clamp arm end and the second spring end connected to the carousel mechanism;

an adjustable ear attached to the clamp arm between the pivot point and the second end;

camming mechanism for pivoting the clamp plate, the camming mechanism contacting the ear;

the underfolding mechanism pivotally mounted to the carousel mechanism adjacent each wrapping station;

the pair of side folder mechanisms fixedly mounted to the carousel mechanism adjacent each wrapping station; and a sealing drum rotationally mounted adjacent to the carousel.

3. An apparatus for wrapping workpieces, the apparatus comprising:

a frame structure;

a rotating carousel mechanism having a plurality of wrapping stations, the carousel mechanism coupled to the frame structure;

each wrapping station having a clamping mechanism, an underfolding mechanism, and a pair of side folder mechanisms, the clamping mechanism pivotally mounted to the carousel mechanism adjacent each wrapping station;

the underfolding mechanism pivotally mounted to the carousel mechanism adjacent each wrapping station, said underfolding mechanism including an underfolder plate;

an underfolder arm having a first end, a second end, a pivot point, and an actuating point;

the first end connected to the underfolder plate and the pivot point pivotally connected to the carousel mechanism;

a camming mechanism for pivoting the underfolder plate, the camming mechanism connected to the arm at the actuating point;

the pair of side folder mechanisms fixedly mounted to the carousel mechanism adjacent each wrapping station; and a sealing drum rotationally mounted adjacent to the carousel.

4. The apparatus of claim 1 wherein the side folder mechanism comprises:

a tongue positioned in planar parallel relation to the end of a workpiece received in a wrapping station of the carousel;

the tongue depending from a substantially cylindrical shoulder piece, the shoulder piece having affixed to its outermost surface a heat resistant resilient sealing pad; and a folder support bar fixedly connected to the frame structure and to the shoulder piece so as to rigidly support the tongue in its preferred position.

5. The apparatus of claim 1 wherein the camming mechanism comprises:

a cam mounted to the frame;

a cam follower riding in the cam;

a connecting rod having a first and a second end, the first end connected to the cam follower and the second end connected to the underfolder arm.

6. The apparatus of claim 1 further including:

an ejector bar mounted within each wrapping station;

a cam mounted to the frame;

a cam follower riding in the cam;

a connecting rod having a first and a second end, the first end connected to the cam follower and the second end connected to the ejector bar.

7. The apparatus of claim 1 further including:

an infeed conveyor connected to the frame.

8. A carousel wrapper for wrapping workpieces, the carousel wrapper comprising:

a frame;

a rotating carousel having sides and a plurality of pockets, the rotating carousel supported within the frame;

each pocket having a clamp plate, a clamp arm, an underfolder plate, an underfolder arm, and a pair of side folder mechanisms;

the clamp plate mounted to the clamp arm and the underfolder plate mounted to the underfolder arm;

the clamp arm and underfolder arm pivotally attached to the carousel;

the pair of side folder mechanisms attached to the carousel and framing each of the pockets;

a sealing drum rotationally mounted adjacent to the carousel and including a shaft mounted to the frame structure of the carousel;

a pair of side plates fixedly mounted in identical orientation upon the shaft;

a plurality of sealing rollers adjustably mounted between the side plates;

each sealing roller being mounted upon a pair of slide bars retained between the respective side plates by a plurality of rollers that permit the sealing rollers to be moved in a linear fashion in radial relation to the center of the shaft;

a pair of electrically activated air cylinders coupled to the slide bars so as to adjust the radial position of the sealing rollers; and the rotation of the sealing drum being synchronized with the rotation of the carousel; whereby a sealing roller of the sealing drum will contact a workpiece received in the pockets of the carousel and seal about the workpiece a sheet of wrapping film.

9. The apparatus of claim 8 wherein a sealing belt is interposed between the sealing drum and the carousel;

the sealing rollers of the sealing drum contacting the sheet of wrapping film wrapped about the workpieces received in the pockets of the carousel.

10. carousel wrapper for wrapping workpieces, the carousel wrapper comprising:

a frame;

a rotating carousel having a plurality of pockets, the rotating carousel supported within the frame;

each pocket having a clamp plate, a clamp arm, an underfolder plate, an underfolder arm, and a pair of side folder mechanisms;

the clamp plate mounted to the clamp arm and the underfolder plate mounted to the underfolder arm;

the clamp arm and underfolder arm pivotally attached to the carousel;

the pair of side folder mechanisms attached to the carousel and framing each of the pockets;

an exit conveyor connected to the frame;

the exit conveyor comprising an upper belt and lower belt, the belts being mounted a fixed distance apart and on pivot points, the fixed distance being adjustable;

a linkage pivoting the belts on the pivot points;

a pair of side folder plates pivotally connected to the upper belt and the lower belt a fixed distance apart on respective sides of the upper belt and lower belt;

the exit conveyor being arranged to receive a plurality of workpieces from the pockets of the carousel.

11. An apparatus for wrapping workpieces, the apparatus comprising:

a frame;

an infeed conveyor, the infeed conveyor connected to the frame; a carousel having a top surface, side surfaces and plurality of pockets, the carousel being rotatably supported on an axle within the frame;

a wrapping film feeder mechanism for feeding wrapping film, the wrapping film feeder mechanism being mounted to the frame;

an exit conveyor, the exit conveyor mounted to the frame, the exit conveyor being arranged to receive workpieces from the pockets of the carousel;

a discharge conveyor, the discharge conveyor mounted to the frame and arranged to receive workpieces from the exit conveyor;

a sealing conveyor, the sealing conveyor arranged to receive workpieces from the discharge conveyor;

the wrapping film feeder mechanism comprising an unwinder mechanism, a dancer assembly, a pair of pinch rollers, and a rotary blade;

the unwinder mechanism mounted to the frame;

the dancer assembly, pinch rollers and rotary blade mounted within the frame;

a ramp mounted within the frame adjacent the carousel, the ramp having a surface, the surface beginning a predetermined distance from the carousel and approaching the carousel as the ramp extends;

a chain conveyor having a plurality of flights, the flights pushing the workpieces up the ramp;

each carousel pocket having a pivotable clamp arm, a pivotable underfolder arm, a pair of side folder mechanisms, and an ejector mechanism;

a clamp plate mounted to the clamp arm and an underfolder plate mounted to the underfolder arm;

a first cam mechanism connected to the frame, the first cam mechanism pivoting the clamp and underfolder arms;

a second cam mechanism mounted to the frame, the second cam mechanism connected to the ejector mechanism;

a sealing drum rotationally mounted adjacent to the carousel so as to seal a film wrapping sheet about the workpieces received in the pockets of the carousel; and a sealing belt interposed between the workpieces received in the pockets of the carousel and the sealing drum.

12. An apparatus for wrapping workpieces, the apparatus comprising:

a frame structure;

a rotating carousel mechanism having a plurality of wrapping stations, the carousel mechanism coupled to the frame structure;

each wrapping station having a clamping mechanism, an underfolding mechanism, and a pair of side folder mechanisms;

the clamping mechanism pivotally mounted to the carousel mechanism adjacent each wrapping station and including a clamp plate;

a clamp arm having a first end, a second end, and a pivot point;

the first end connected to the clamp plate and the pivot point pivotally connected to the carousel mechanism;

a spring having two ends, the first spring end connected to the second clamp arm end and the second spring end connected to the carousel mechanism;

an adjustable ear attached to the clamp arm between the pivot point and the second end;

a camming mechanism for pivoting the clamp plate, the camming mechanism contacting the ear;

the underfolding mechanism pivotally mounted to the carousel mechanism adjacent each wrapping station;

the pair of side folder mechanism rigidly mounted to the carousel mechanism adjacent the wrapping station so as to frame the wrapping station; and a sealing belt situated so as to cover at least one wrapping station of the carousel.

13. An apparatus for wrapping workpieces, the apparatus comprising:

a frame structure;

a rotating carousel mechanism having a plurality of wrapping stations, the carousel mechanism coupled to the frame structure;

each wrapping station having a clamping mechanism, an underfolding mechanism, and a pair of side folder mechanisms;

the clamping mechanism pivotally mounted to the carousel mechanism adjacent each wrapping station;

the underfolding mechanism pivotally mounted to the carousel mechanism adjacent each wrapping station;

the pair of side folder mechanism rigidly mounted to the carousel mechanism adjacent the wrapping station so as to frame the wrapping station;

a sealing belt situated so as to cover at least one wrapping station of the carousel;

a sealing drum rotationally mounted adjacent to the carousel and including a shaft mounted to the frame structure of the carousel;

a pair of side plates fixedly mounted in identical orientation upon the shaft;

a plurality of sealing rollers adjustably mounted between the side plates one hundred and eighty degrees apart;

each sealing roller being mounted upon a pair of slide bars retained between the respective side plates by a plurality of rollers that permit the sealing rollers to be moved in a linear fashion in radial relation to the center of the shaft;

a pair of electrically activated air cylinders coupled to the slide bars so as to adjust the radial position of the sealing rollers;

the rotation of the sealing drum being synchronized with the rotation of the carousel such that a sealing roller of the sealing drum will contact a lap of a sheet of wrapping film wrapped about the workpiece received in the pockets of the carousel and seal the sheet of wrapping film about the workpiece.

* * * * *